US006060205A

United States Patent [19]

Takeichi et al.

[11] Patent Number: 6,060,205

[45] Date of Patent: May 9, 2000

[54] IMAGE FORMING APPARATUS

[75] Inventors: Ryuta Takeichi, Yokohama; Narihito Kojima, Numazu; Hiroshi Nagame, Numazu; Yohta Sakon, Numazu; Akiyo Nakajima, Yokohama, all of Japan

[73] Assignee: Ricoh Company, Ltd., Tokyo, Japan

[21] Appl. No.: 09/294,004

[22] Filed: Apr. 19, 1999

[30] Foreign Application Priority Data

| | | | |
|---|---|---|---|
| Apr. 17, 1998 | [JP] | Japan | 10-107553 |
| Apr. 28, 1998 | [JP] | Japan | 10-118070 |
| Apr. 30, 1998 | [JP] | Japan | 10-121300 |
| May 28, 1998 | [JP] | Japan | 10-146753 |
| Jul. 16, 1998 | [JP] | Japan | 10-202052 |
| Jul. 16, 1998 | [JP] | Japan | 10-202053 |
| Jul. 16, 1998 | [JP] | Japan | 10-202054 |
| Jul. 22, 1998 | [JP] | Japan | 10-206093 |

[51] Int. Cl.[7] ..... G03G 13/14

[52] U.S. Cl. ..... 430/126; 399/297; 399/346

[58] Field of Search ..... 430/126; 399/297, 399/346

[56] References Cited

U.S. PATENT DOCUMENTS

| | | | |
|---|---|---|---|
| 4,990,418 | 2/1991 | Mukoh et al. | 430/56 |
| 5,264,903 | 11/1993 | Nagame et al. | 355/297 |
| 5,389,478 | 2/1995 | Yoshida et al. | 430/59 |
| 5,390,015 | 2/1995 | Nagame et al. | 355/305 |
| 5,452,061 | 9/1995 | Kojima et al. | 355/219 |
| 5,870,659 | 2/1999 | Maruyama et al. | 399/299 |

OTHER PUBLICATIONS

Tokuhashi Masaki et al, Patent Abstract of Japan, "Cleaning Device for Image Forming Device," (06324603) Nov. 25, 1994.

Kai Yoshinori et al, Patent Abstract of Japan, "Cleaning Device for Image Forming Device," (06324604) Nov. 25, 1994.

Minoru Suzuki, Patent Abstract of Japan, "Blade Pressurizing Device for Blade Cleaning," (56–142567) Nov. 6, 1981.

Arai Makoto et al, Patent Abstract of Japan, "Image Forming Device," (06342236) Dec. 13, 1994.

Yoshida Akira et al, Patent Abstract of Japan, "Electrophotographic Sensitive Body and Electro–Photographic Device With The Same," (06230590) Aug. 19, 1994.

Kikuchi Norio, Patent Abstract of Japan, "Device for Supplying Lubricant to Image Carrier in Electrophotographic Device," (08095455) Apr. 12, 1996.

Tokuhashi Masaki et al, Patent Abstract of Japan, "Lubricant Supplying Apparatus in Image Forming Apparatus," (07295451) Nov. 10, 1995.

Suga Akira, Patent Abstract of Japan, "Lubricant Applicator," (08054807) Feb. 27, 1996.

Tomio Arai, Patent Abstract of Japan, "Cleaning Device," (4–264482) Sep. 21, 1992.

*Primary Examiner*—Mark Chapman
*Attorney, Agent, or Firm*—Oblon, Spivak, McClelland, Maier & Neustadt, P.C.

[57] ABSTRACT

An image forming apparatus comprising a lubricant supplying device which supplies a lubricant to a rotating image carrier, wherein the lubricant comprises at least one of low molecular weight polytetrafluoroethylene, a fluorine-containing resin including a filler, polytetrafluoroethylene which has been subjected to heat or radiation decomposition treatment, a fluorine-containing resin which has been prepared by a compression molding method, and a porous fluorine-containing resin. The lubricant preferably has a concave portion on the surface thereof contacting the image carrier. The lubricant is preferably disposed so that an acute angle formed by a line parallel to a compression direction of the lubricant, during the compression molding of the lubricant, and a line parallel to a moving direction of the image carrier, is from about 45 to about 90°.

61 Claims, 22 Drawing Sheets

IMAGE FORMING APPARATUS

BACKGROUND OF THE INVENTION

1. Field of the Invention

The present invention relates to an image forming apparatus such as copiers, printers, facsimile machines and the like, and more particularly to an image forming apparatus having a mechanism that supplies a lubricant to the surface of an image carrier.

2. Discussion of the Background

Currently, an electrophotographic image forming apparatus as shown in FIG. 43 is used as copiers, printers and facsimile machines. In FIG. 43, a charging roller 122, an exposing unit 124, a developing unit 126, an image transfer unit 128, a cleaning blade 130 which serve as a cleaning device, and a discharger 132 are disposed around a photoconductor 120 which serves as an image carrier. Images are formed by the following processes:

(1) charging the photoconductor 120 with the charging roller 122 (charging process);

(2) imagewise irradiating the photoconductor 120 with light to form electrostatic latent images thereon (exposing process);

(3) developing the latent images with the developing unit 126 including a toner to form toner images on the photoconductor 120 (developing process);

(4) transferring the toner images with the image transfer unit 128, for example, onto a receiving paper P which is timely fed to an image transfer position with a pair of registration rollers 134 (image transfer process);

(5) feeding the receiving paper P to a fixing unit (not shown) to fix the toner images upon application of heat and pressure (image fixing process); and (6) scraping a toner remaining on the photoconductor 120 with the cleaning blade 130, and discharging the photoconductor 120 with the discharger 132, to allow the photoconductor 120 to be ready for the next cycle of these image forming processes (cleaning and discharging process). These processes are performed while the photoconductor 120 is rotated in a direction shown by an arrow.

Among these members in the image forming apparatus as shown in FIG. 43, the charging roller 122, the image transfer unit 128, the cleaning blade 130 etc., directly contact the surface of the photoconductor 120. When the photoconductive layer of the photoconductor 120 is abraded in a certain amount with these members, the electric characteristics and photosensitive characteristics of the photoconductor 120 change, and thereby image qualities deteriorate when the predetermined image forming conditions are maintained. Thus, the abrasion of the photoconductive layer shortens the life of the photoconductor 120.

Among the members which directly contact the surface of the photoconductor 120, the cleaning blade 130 abrades the photoconductor 120 more seriously than the other members. This is because the cleaning blade 130 dynamically contacts, i.e., scrapingly contacts, the surface of the photoconductor 120 to clean the toner remaining thereon.

The abrasion of the photoconductor 120 caused by the cleaning blade 130 is broadly classified into the following two types:

(1) abrasion caused by shear strength generated between the cleaning blade 130 and the photoconductor 120; and (2) abrasion caused by the abrasive effects of the toner which is sandwiched between the cleaning blade 130 and the photoconductor 120 and which works like a whetstone.

The abrasion of the photoconductor 120 is determined depending on various factors which are as follows:

(1) mechanical strength of the photoconductor 120;

(2) pressure of contact of the cleaning blade 130 with the photoconductor 120;

(3) composition of the toner;

(4) coefficient of friction of the photoconductor 120; and the like.

In attempting to decrease the abrasion of the photoconductor 120, which is caused by the contact of the cleaning blade 130, Japanese Laid-Open Patent Publications Nos. 6-324603 and 6-324604 have disclosed methods in which a lubricant is supplied to the surface of the photoconductor 120. In these methods, a lubricant supplying device 136 is used as shown in FIGS. 43 and 44.

The lubricant supplying device 136 mainly consists of a case 138 which is fixed to a main body of the apparatus, a lubricant 140 which is movably contained in the case 138, a lubricant supplying roller 142 which contacts the lubricant 140 to shave the lubricant 140, and a lubricant supplying brush 144 which takes the shaved lubricant 140 from the lubricant supplying roller 142 and supplies the lubricant 140 to the surface of the photoconductor 120. The lubricant 140 is forced to be pressed to the lubricant supplying roller 142 with springs 146, and therefore almost all the lubricant 140 can be exhausted by being applied little by little to the lubricant supplying roller 142. The thickness of the lubricant 140 decreases with elapse of time, however, the lubricant 140 always contacts the supplying roller 142 because of being pressed thereto with springs 146. As shown in FIG. 44, the lubricant 140 is shaped like a rectangular prism and is placed so as to be parallel to the longitudinal direction of the photoconductor 120. The case 138 shown in FIG. 43 has a shape corresponding to the shape of the lubricant 140 and therefore the lubricant 140 can smoothly move therethrough.

When the lubricant 140 is applied onto the surface of the photoconductor 120, the coefficient of friction between the cleaning blade 130 and the photoconductor 120 decreases, resulting in decrease of the shear strength generated therebetween, and thereby the abrasion of the photoconductor 120 can be decreased. Solid lubricants such as zinc stearate are used as the lubricant 140.

As shown in FIG. 45, Japanese Laid-Open Patent Publication No. 6-324604 discloses a lubricant supplying device 136 without a supplying roller 142 in which the lubricant 140 is applied to the surface of the photoconductor 120 with the supplying brush 144. The lubricant is contained in a case 138 and pressed with a spring 146.

Japanese Laid-Open Patent Publication No. 7-295451 discloses a technique in which a layer of a lubricant is uniformly formed on a roller using a scraper.

In addition, Japanese Laid-Open Patent Publication No. 8-54807 discloses a technique in which a roller on which a layer of a solid lubricant such as zinc stearate is formed is directly brought into contact with an image carrier to avoid formation of an uneven layer of the lubricant on the image carrier, which is caused by uneven abrasion of the solid lubricant.

Further, Japanese Laid-Open Patent Publication No. 8-95455 discloses a technique in which a solid lubricant such as waxes and metal salts of fatty acids is applied to an image carrier by means of a supplying member.

Furthermore, Japanese Laid-Open Patent Publication No. 4-264482 discloses a technique in which a counter-contact-type cleaning blade in which a layer of a polytetrafluoroethylene (hereinafter referred to as PTFE) resin is formed on the surface of the blade to be contacted with an image carrier is provided to decrease the abrasion of the image carrier.

Referring again to FIG. 43, in such lubricant supplying methods, it is preferable to supply the lubricant 140 to the photoconductor 120 as soon as possible when the lubricant 140 is desired to be supplied thereto, in order to prevent the photoconductor 120 from abrading. Namely, the lubricant 140 is preferably shaved easily with the lubricant supplying roller 142 so as to be rapidly supplied to the photoconductor 120.

In addition, when the lubricant 140 is applied to the photoconductor 120 in an excess amount, the following problems tend to occur:

(1) toner adheres in the background part of toner images formed on the photoconductor 120, resulting in background fouling of the transferred images; and (2) the quantity of toner of character toner images formed on the photoconductor 120, resulting in deterioration of image qualities of character images.

In contrast, when the lubricant 140 is applied to the photoconductor 120 in an insufficient amount, the following problems tend to occur:

(1) small particles included in a toner tend to adhere to the photoconductor 120, resulting in background fouling or formation of a toner layer on the photoconductor 120 (referred to as a toner filming problem), and thereby image qualities deteriorate; and (2) the cleaning blade 130 tends to be turned up because the photoconductor 120 has an insufficient coefficient of friction, resulting in poor cleaning effect, and thereby fouling occurs in the background of toner images.

However, there is no satisfactory image forming apparatus nor image forming method in these points of view.

Because of these reasons, a need exists for an image forming apparatus which can stably produce good images, even when used for a long time, by allowing the surface of an image carrier to keep proper frictional properties.

SUMMARY OF THE INVENTION

Accordingly, an object of the present invention is to provide an image forming apparatus which can stably produce good images, even when used for a long time, by effectively decreasing the frictional resistance of the surface of the image carrier.

Another object of the present invention is to provide an image forming apparatus in which a proper amount of a lubricant is continuously applied to an image carrier to stably use the image carrier for a long time.

Briefly these objects and other objects of the present invention as hereinafter will become more readily apparent can be attained by an image forming apparatus including a lubricant supplying device which supplies a lubricant to an image carrier to decrease the abrasion of the image carrier, wherein the lubricant includes low molecular weight polytetrafluoroethylene.

The low molecular weight PTFE preferably has a number average molecular weight not greater than 5 million.

Preferably, the lubricant further includes one of materials other than the polytetrafluoroethylene, such as fluorine-containing resin including tetrafluoroethylene-perfluoroalkylvinyl ether copolymers and tetrafluoroethylene-hexafluoropropylene copolymers.

Alternatively, the lubricant includes a complex of a first polytetrafluoroethylene having a relatively high molecular weight and a second polytetrafluoroethylene having a relatively low molecular weight compared to the first polytetrafluoroethylene, a compression molding fluorine-containing resin, a fluorine-containing resin which includes a filler, or a porous fluorine-containing resin.

In another aspect of the present invention, an image forming apparatus is provided that includes a lubricant supplying device configured to supply a lubricant to an image carrier to decrease the abrasion of the image carrier, wherein the lubricant directly contacts the surface of the image carrier, and wherein at least one concave portion is formed on the surface of the lubricant to be contacted with the image carrier.

In yet another aspect of the present invention, an image forming apparatus is provided that includes a lubricant supplying device configured to supply a lubricant to an image carrier to decrease the abrasion of the image carrier, wherein the lubricant includes compression molded polytetrafluoroethylene, and wherein the lubricant is prepared so that the longitudinal direction of the compression molded polytetrafluoroethylene is substantially vertical to the compression direction thereof.

In a further aspect of the present invention, an image forming apparatus is provided that includes a lubricant supplying device configured to supply a lubricant to an image carrier to decrease the abrasion of the image carrier, wherein the lubricant includes compression molded polytetrafluoroethylene and directly contacts the surface of the image carrier, and wherein the lubricant is disposed on the image carrier such that an acute angle formed by a line which is parallel to the rotating direction of the image carrier and a line parallel to the compression direction of the compression molded polytetrafluoroethylene is from 45° to 90°.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, a first embodiment of the image forming apparatus of the present invention will be explained in detail with reference to drawings.

Figure 1:
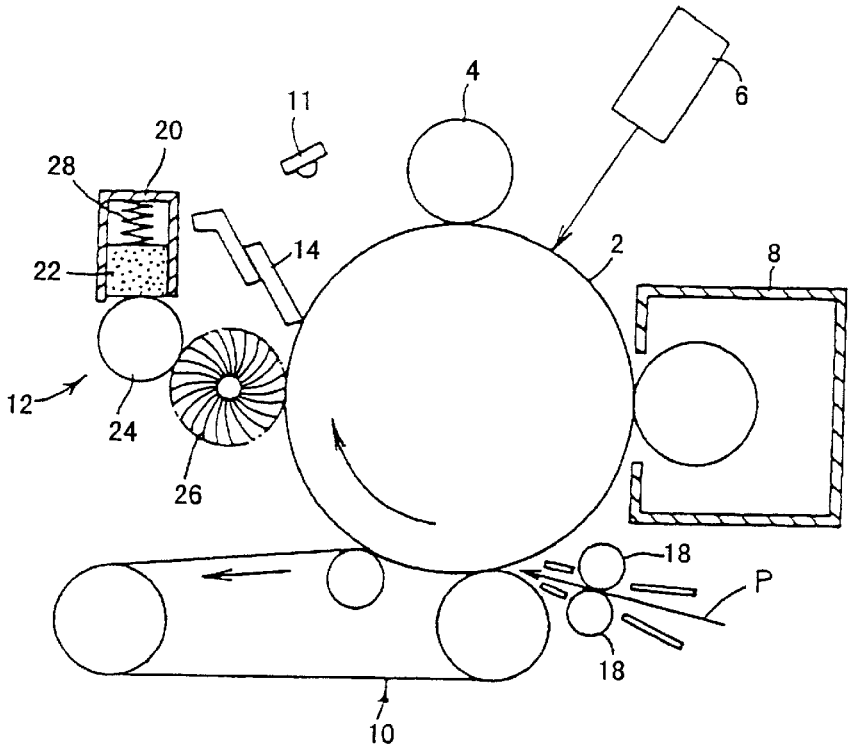
FIG. 1 is a schematic side view illustrating a primary part of an embodiment of the image forming apparatus of the present invention.
Figure 43:
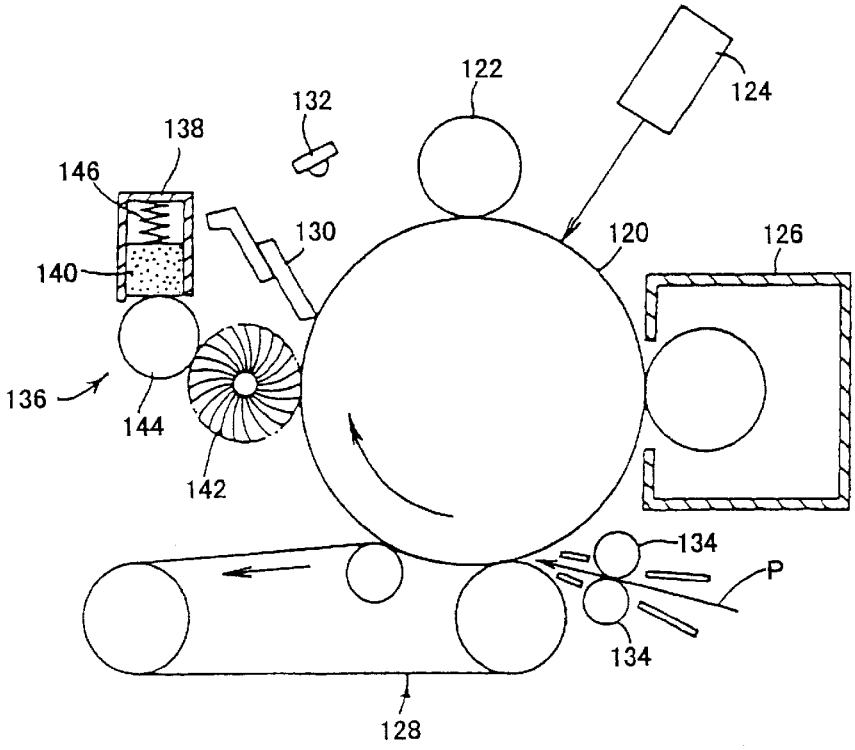
Fig. 43 BACKGROUND ART
FIG. 43 is a schematic view illustrating a primary part of a background image forming apparatus including a lubricant supplying device.
Figure 44:
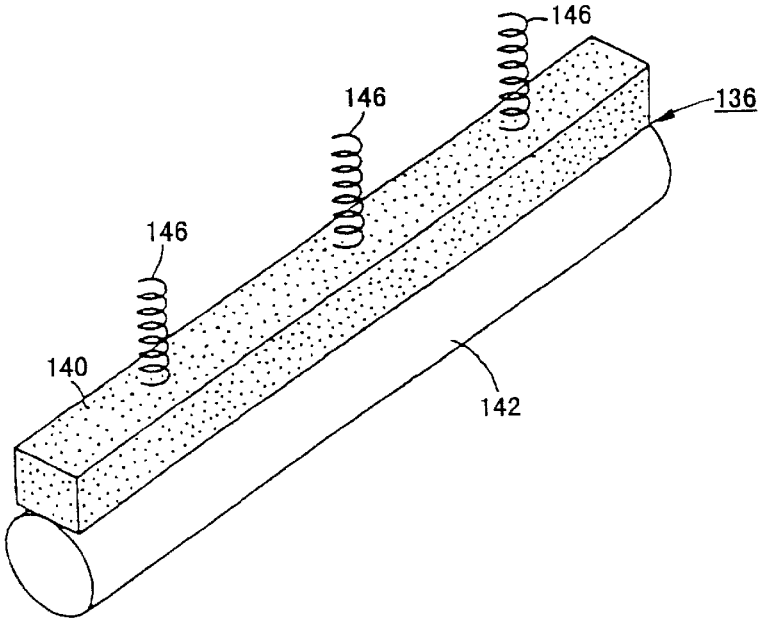
Fig. 44 BACKGROUND ART
FIG. 44 is a schematic perspective view illustrating a lubricant for use in the background image forming apparatus shown in FIG. 43.
Figure 45:
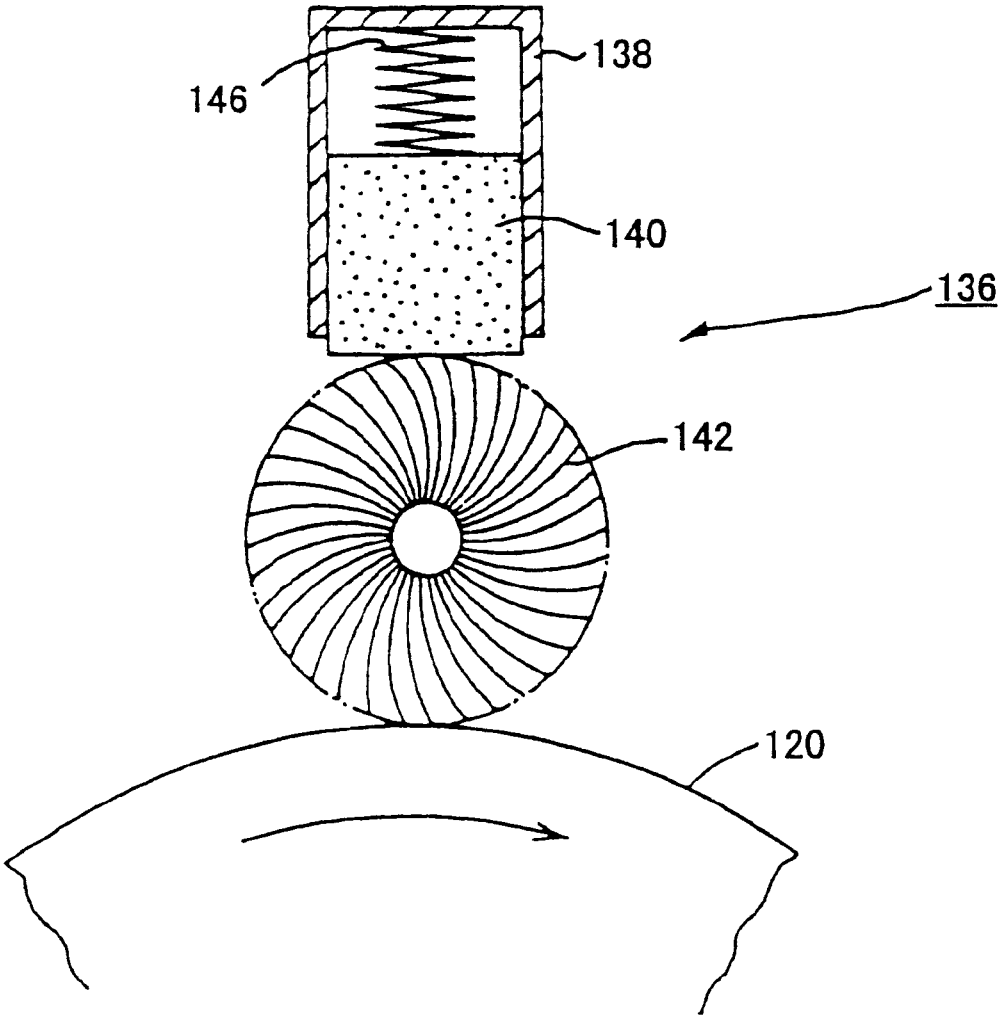
Fig. 45 BACKGROUND ART
FIG. 45 is a schematic view illustrating a background lubricant supplying device.

FIG. 1 is a schematic view illustrating a primary part of the electrophotographic image forming apparatus of the present invention, which is similar to the background image forming apparatus as shown in FIG. 43.

In FIG. 1, a charging roller 4, an exposing unit 6, a developing unit 8, an image transfer unit 10, a lubricant supplying device 12, a cleaning blade 14 and a discharger 11 are disposed around a photoconductor 2 which serves as an image carrier. Images are formed by the following process:

(1) charging the photoconductor 2 with the charging roller 4 (charging process);

(2) imagewise irradiating the photoconductor 2 with light by the exposing unit 6 to form electrostatic latent images thereon (exposing process);

(3) developing the latent images with the developing unit 8 including a toner to form toner images on the photoconductor 2 (developing process);

(4) transferring the toner images, for example, onto a receiving paper P which is timely fed to an image transfer position with a pair of registration rollers 18, while the image transfer unit 10 is rotating in a direction shown in by an arrow (image transfer process);

(5) feeding the receiving paper P to a fixing unit (not shown) to fix the toner images upon application of heat and pressure (fixing process); and (6) scraping a toner remaining on the photoconductor 2 with the cleaning blade 14 (cleaning process) and discharging the photoconductor 2 with the discharger 11 (discharging process), to allow the photoconductor 2 to be ready for the next cycle of these image forming processes. These processes are performed while the photoconductor 2 is rotating in a direction as shown by an arrow.

The lubricant supplying device 12 includes a case 20 which is fixed to a main body of the apparatus, a lubricant 22 which is contained in the case 20 and which can freely move in the case 20, a lubricant supplying roller 24 which contacts the lubricant 22 to shave the lubricant 22, and a lubricant supplying brush 26 which takes a part of the lubricant 22 from the supplying roller 24 and supplies the lubricant 22 to the surface of the photoconductor 2. As shown in FIG. 1, the lubricant 22 is shaped like a rectangular prism. The lubricant supplying roller 24 and the lubricant supplying brush 26 have a cylindrical form and disposed so as to be parallel to the longitudinal direction of the photoconductor 2. The lubricant 22 is forced to be pressed to the supplying roller 24 with a spring 28, and therefore almost all the lubricant 22 can be exhausted by being applied little by little to the lubricant supplying roller 24. The thickness of the lubricant 22 decreases with elapse of time, however, the lubricant 22 always contacts the lubricant supplying roller 24 because of being pressed thereto with the spring 28.

Figure 2:
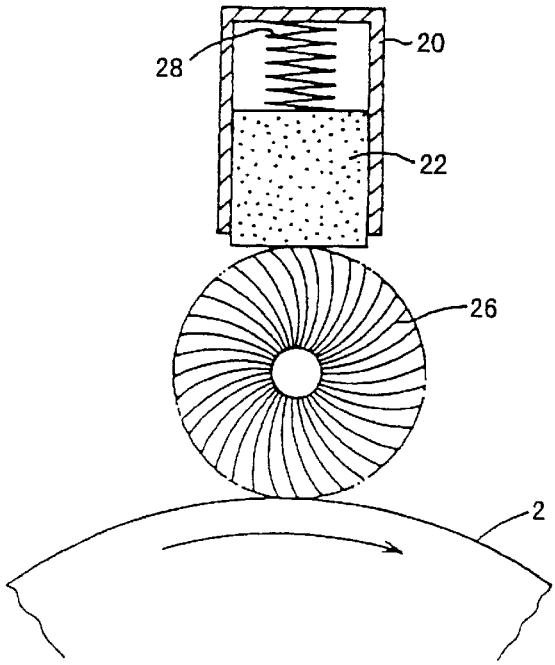
FIG. 2 is a schematic side view illustrating an embodiment of the lubricant supplying device of the image forming apparatus of the present invention.

The lubricant supplying device 12 is not limited to the structure as shown in FIG. 1. For example, the lubricant 22 can be supplied only by the supplying brush 26 without the supplying roller 24 as shown in FIG. 2.

Figure 3:
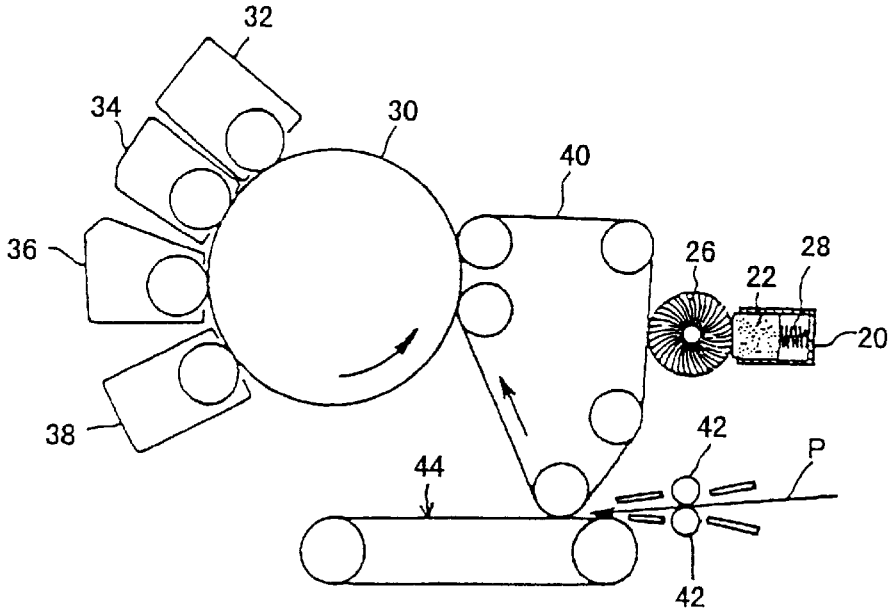
FIG. 3 is a schematic side view illustrating a primary part of another embodiment of the image forming apparatus of the present invention, which includes an intermediate transfer belt as an image carrier.

In addition, an image carrier to which the lubricant 22 is to be supplied is not limited to the photoconductor 2, and may be a transfer belt 40 as shown in FIG. 3. FIG. 3 illustrates a full color image forming apparatus. Four color developing units 32, 34, 36 and 38, each of which includes a different color toner therein, are provided around a photoconductor 30. Each color toner image which is formed on the photoconductor 30 is transferred one by one on the intermediate transfer belt 40 so that a full color toner image is formed on the intermediate transfer belt 40 which rotates in a direction shown by an arrow. The full color image is then transferred to a receiving paper P which is timely fed with a pair of registration rollers 42 to an image transfer position of a transfer belt 44. In order to remove a residual toner on the intermediate transfer belt 40, a cleaning blade (not shown in FIG. 3) is provided at a location on the intermediate transfer belt 40. An abrasion problem similar to that of the photoconductor 2 (FIG. 1) tends to occur in the intermediate transfer belt 40, and therefore a lubricant supplying device is provided on the intermediate transfer belt 40.

Figure 4:
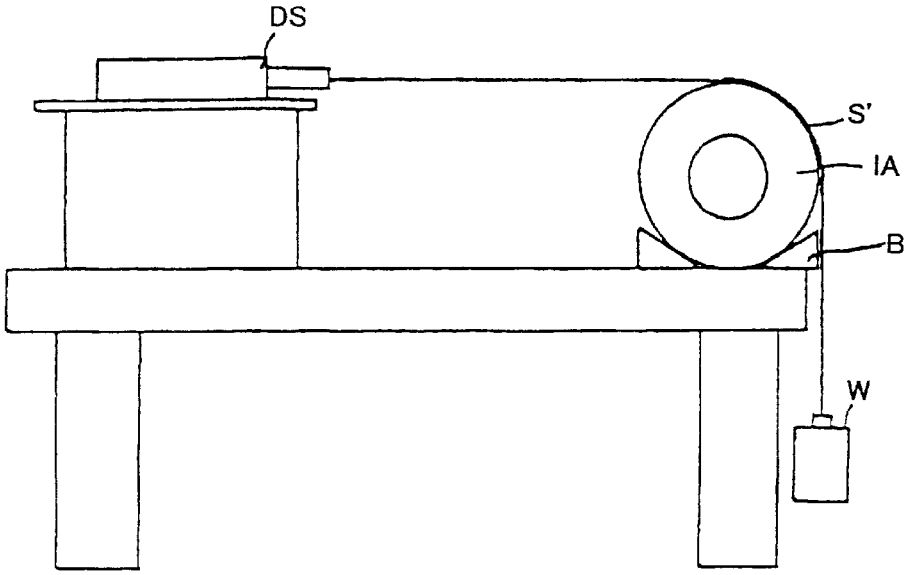
FIG. 4 is a schematic view of a measuring instrument by which coefficient of friction between a receiving paper and a photoconductor can be measured using an Euler belt method.

Measuring methods and the results of coefficient of static friction of an image carrier (photoconductor 2) will be hereinafter explained. In the present invention, coefficient of static friction of an image carrier is measured by an Euler belt method in which coefficient of static friction between an image carrier and a receiving paper is measured. A measuring instrument for use in the Euler belt method is shown in FIG. 4.

A character S' denotes a paper to be measured which have a middle thickness (#6200 paper manufactured by Ricoh Co.,Ltd.) and a dimension of 30 mm in width and 250 mm in length. Two hooks are set at each longitudinal end of the paper S', and a load w (100 g) is set at one hook and a digital force gauge DS is set at the other hook. The paper S' is set in the measuring instrument so as to contact a photoconductor 1A, as shown in FIG. 4. The paper S' is pulled with the digital force gauge DS. Provided when a force at which the paper S' starts to move is F, the coefficient of static friction of the photoconductor 1A is determined by the following equation (1):

$$\mu=(\pi/2)ln(F/w) \quad (1)$$

wherein $\mu$ is the coefficient of static friction of the photoconductor 1A, F is the measured value of the force, and w is the load (gram-force).

When the photoconductor 2 has coefficient of static friction not greater than about 0.4 which is measured by the Euler belt method, the photoconductor 2 (image carrier) has good resistance to abrasion.

In the present invention, the coefficient of static friction of the photoconductor 2 (image carrier) is preferably not greater than about 0.4, and more preferably from about 0.3 to about 0.1, to obtain good resistance to abrasion and good cleaning ability. This target value of the coefficient of static friction of the photoconductor 2 can be achieved by the lubricant supplying device 12. When the coefficient of static friction of the photoconductor 2 is too small, image defects tend to be generated, which is caused by adhesion of ionized materials. In addition, when the coefficient of friction is too small, character images become unclear and half tone images becomes uneven because the toner adhered to the photoconductor 2 slips.

Complex materials including low molecular weight polytetrafluoroethylene (hereinafter referred to as low molecular weight PTFE) are used as one of suitable materials for use as the lubricant 22 in the present invention.

The feature of the low molecular weight PTFE is hereinafter explained in comparison with general PTFE. In general, PTFE has very high melt viscosity and therefore it is hard to mold PTFE by injection molding methods or extrusion molding methods. Therefore PTFE is molded by a molding method including a sintering process in which powdery PTFE is preliminary molded (in general at room temperature), and the molded PTFE is then heated at a temperature higher than the melting point, i.e., from 350 to 400° C., to form a PTFE molding. Specific examples of the molding method include compression molding methods, ram extrusion molding methods, paste extrusion molding methods and the like.

Suitable powdery PTFEs for use in such molding methods include molding powders and fine powders. In general, the molding powders are used for the compression molding methods and ram extrusion molding methods, and fine powders are used for the paste extrusion molding methods.

The molding powders are a general name of powdery materials which are prepared by pulverizing an original powder obtained by suspension polymerization into a powder having a particle diameter of from tens μm to hundreds μm, and then subjected to one or more treatments such as granulation treatment, fine powdering treatment and preliminary heating treatment which are performed depending on the use of the powder.

The fine powders are prepared by coagulating a latex obtained by emulsion polymerization and then drying. The particle diameter of the resultant fine powder is from 300 to 600 μm.

In general, low molecular weight PTFE has a number average molecular weight of from thousands to hundreds thousand, whereas the molding powders and fine powders of PTFE have a number average molecular weight of from 5 to 6 million or more. Such low molecular weight PTFE is used as an additive for resins other than PTFE, oils, inks, paints and the like.

In the present invention, low molecular weight PTFE includes PTFE which is manufactured by polymerization methods, radiation decomposition methods, heat decomposition methods etc. so as to have a relatively low number average molecular weight such as not greater than about 5 million and which is practically used as molding materials for compression molding. The molecular weight is preferably about 1 million or less.

Next, manufacturing methods of the low molecular weight PTFE will be explained.

At first, the heat decomposition methods will be explained. PTFE is very stable to heat and a weight loss cannot be observed at a general molding temperature. The molding temperature of PTFE is generally about 400° C. or lower. When PTFE is heated at a temperature higher than the molding temperature, the weight gradually decreases, which is caused by heat decomposition of PTFE. This heat decomposition is accelerated at a temperature higher than about 500° C. Therefore low molecular weight PTFE can be obtained by heating PTFE under proper temperatures.

Next, the radiation decomposition methods will be explained. PTFE is a radiation decomposing polymer. PTFE is very sensitive to radiation such as γ-ray, electron beams and the like compared to other polymers. When PTFE is exposed to radiation, PTFE decomposes, resulting in formation of low molecular weight PTFE.

Methods for measuring molecular weight of PTFE are explained. Since PTFE does not dissolve in almost all solvents and has very high melt viscosity, general molecular weight measuring methods cannot be used. In the present invention, the molecular weight of PTFE is determined by the following direct or indirect measuring methods, but the measuring method is not limited thereto:

(1) A Method Utilizing Specific Gravity

Specific gravity of a molded PTFE is commonly used as a proxy of the molecular weight of PTFE. The smaller the specific gravity of molded PTFE, the greater the molecular weight of the molded PTFE. This is because PTFE having relatively high molecular weight has poor moving ability and therefore hardly crystallizes and tends to achieve an amorphous state. Therefore PTFE having a relatively high molecular weight has a relatively small specific gravity.

(2) A Method Utilizing Heat of Crystallization

Molecular weight of PTFE can also be determined by measuring heat of crystallization thereof using a differential scanning calorimeter (DSC). This method has an advantage in that heat of crystallization can be measured using powdery PTFE and without using molded PTFE.

Next, the friction characteristics and lubricating feature of PTFE will be explained.

Figure 5:
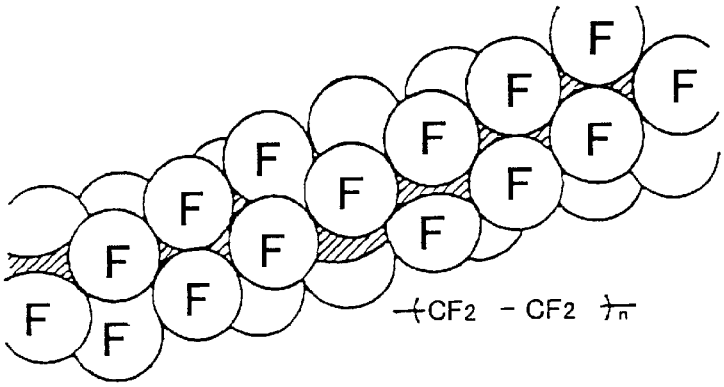
FIG. 5 is a schematic view illustrating the structure of a molecular of polytetrafluoroethylene.
Figure 6:
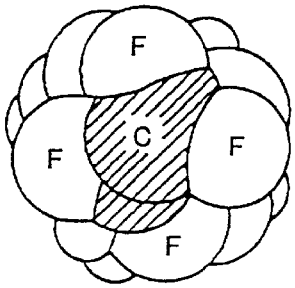
FIG. 6 is a schematic view illustrating the cross-sectional structure of amolecular of polytetrafluoroethylene.

The structure of a molecule of PTFE is shown in FIGS. 5 and 6 (cross section). PTFE has a chemical structure in which a unit $CF_2$ is simply repeated. Therefore PTFE is a symmetric and linear polymer. In addition, PTFE is a non-polar polymer, and has a very weak inter-molecular cohesive force. The surface of the molecular chain is very smooth. PTFE has low coefficient of friction because of having a weak inter-molecular cohesive force and a smooth surface of the molecular chain.

Low molecular weight PTFE is very soft, and easily slips at an interface between molecules because of having weak inter-molecular cohesive force. Therefore, when PTFE is abraded with another material, PTFE easily transferred to the material, resulting in formation of a PTFE layer on the material. When a PTFE layer is formed on the material, the friction between PTFE and the material becomes the friction between PTFE and the PTFE layer, resulting in decrease of coefficient of friction. This is known as one of the reasons why the friction resistance is low between PTFE and another material which is moving. Therefore PTFE is suitable as a lubricant for use in the image forming apparatus of the present invention.

Referring again to FIGS. 1 and 3, the abrasion of the photoconductor 2 is mainly caused by the friction between the photoconductor 2 and the cleaning blade 14. When the lubricant 22 is applied to the photoconductor 2, it is preferable to directly contact the lubricant 22 with the photoconductor 2 in order to simplify the lubricant supplying device 12, if the lubricant 22 easily transfers to the photoconductor 2. Since PTFE easily transfers to a moving member, the lubricant 22 easily transfers to a rotating member such as the photoconductor 2, the lubricant supplying roller 24, the lubricant supplying brush 26 or the intermediate transfer belt 40. In FIGS. 1 and 2, the lubricant 22 is indirectly supplied to the photoconductor 2 using the lubricant supplying roller 24 and the lubricant supplying brush 26. When the lubricant 22 includes PTFE, the lubricant 22 can be directly contacted with the photoconductor 2. When the lubricant 22 including PTFE is once transferred to the photoconductor 2, the lubricant 22 is exhausted in a small amount because the friction between the lubricant 22 and the transferred layer of the lubricant 22 formed on the photoconductor 2 is very small. Therefore, when the lubricant 22 including PTFE is directly contacted with the photoconductor 2, an excess amount of the lubricant 22 does not transfer to the photoconductor 2.

The slipping between the molecules of PTFE occurs even after PTFE is transferred to the photoconductor 2. A part of PTFE layer which is formed on the photoconductor 2 is removed by the cleaning blade 14, the developing unit 8 and the receiving paper P. Thus, PTFE repeats adhesion to the photoconductor 2 and release therefrom, resulting in maintenance of a lubricant layer having an appropriate thickness on the photoconductor 2. In general, when foreign particles such as ionization materials (NOx, SOx and the like) tend to adhere to the photoconductor 2, blurring occurs in the resultant images. Since the lubricant repeats adhesion to the photoconductor 2 and release therefrom, these foreign particles can be removed, resulting in maintenance of good image qualities.

Hereinafter the feature of low molecular weight PTFE will be explained with reference to its abrasion characteristics.

The mechanical strength such as abrasion resistance of PTFE depends on the molecular weight thereof, and the higher the molecular weight, the better the abrasion resistance. In addition, mechanical strength such as abrasion resistance of polymers generally depends on their inter-molecular cohesive force. Therefore, low molecular weight PTFE has poor mechanical strength, i.e., poor abrasion resistance, which is suitable as the lubricant 22 of the present invention. In order to prepare a PTFE molding having good mechanical strength, PTFE having a molecular weight of from 5 million to 10 million is used. Therefore low molecular weight PTFE has hardly been used as a molding material.

However, the mechanical strength of a molding also depends on the molding conditions because the crystallinity and voids of the resultant molding depends on the molding conditions.

The mechanical strength of low molecular weight PTFE can also be improved by including a filler therein.

Specific examples of such filler include particulate fillers such as carbon black, silica, calcium carbonate, clay, titanium oxide, magnesium oxide, glass beads and talc; fibrous fillers such as glass fiber, carbon fiber, aramid fiber, wollastonite and calcium sulfate; platy filler such as mica, graphite, kaolin, glass flake and ferrite; and other fillers such as alumina, kaolin clay, fine silicic acid, calcium silicate, magnesium oxide, titanium oxide, magnesium hydroxide, aluminum hydroxide, quartz powder, calcium carbonate, magnesium carbonate, feldspar powder, baryta, whiting, agalmatolite clay and anhydrous gypsum. These filler are used alone or in combination.

When the lubricant 22 is directly contacted with the photoconductor 2, the lubricant 22 can be supplied by a low contact pressure. By changing the contact pressure, an amount of supply of the lubricant 22 can be freely controlled in a wide range. However, it is preferable to control the contact pressure so as to be relatively low because heat generated at the contacting position of the lubricant 22 and the photoconductor 2 can be decreased, resulting in prevention of the photoconductor 2 from deteriorating, and in addition, residual toner remained on the surface of the photoconductor 2 can be easily removed without sticking to the photoconductor 2, resulting in prevention of occurrence of image defects.

Next, methods for processing low molecular weight with other materials will be explained.

Since low molecular weight PTFE has a low inter-molecular cohesive force, it is difficult to mold only a low molecular weight PTFE. In order to mold low molecular weight PTFE, at least one of other materials is preferably mixed with the low molecular weight PTFE to form a complex material including low molecular weight PTFE. PTFE has very high stability and a high melting point, and these characteristics cannot be lost even when mixed with other materials during processing operations to make a complex material. When a complex material including low molecular weight PTFE serving as the lubricant 22 is contacted with the photoconductor 2 so that at lest the low molecular weight PTFE contacts the photoconductor 2, the lubricating effects of the low molecular weight PTFE can be exerted.

Methods for making complex materials including low molecular weight PTFE include the following, but the method is not limited thereto;

(1) Molding Methods

Complex materials can be made by one of resin molding methods, which may be the specific molding methods for PTFE, such as compression molding methods, ram extrusion molding methods and paste extrusion molding methods. In addition, injection molding methods, which are the resin molding methods for general resins, may be employed. A suitable method may be selected from these methods depending on the materials used and formulations such as mixing ratio.

(2) Coating Methods

Complex materials can also be made by one of coating methods. A binder resin solution including low molecular weight PTFE is coated on a member and is then dried to form a layer of a complex material on the member. A film may be formed by coating a binder resin solution on a substrate and drying to form a film and then peeling the film from the substrate.

In addition, a dispersion including low molecular weight PTFE may be coated on or included in a porous substrate to form a complex material.

(3) Adhesion Method

Low molecular weight PTFE can be securely adhered to a substrate with an adhesive. In addition, a mixture of low molecular weight PTFE and other materials may be adhered with an adhesive.

Suitable materials for use as the material to be mixed with low molecular weight PTFE include resins such as polycarbonate resins, polyacetal resins, fluorine containing resins, adhesive resins, rubbers and the like. In addition, pigments may be mixed.

EXAMPLE 1

Low molecular weight PTFE and a fluorine-containing resin are mixed to prepare the lubricant 22.

At this point, the fluorine-containing resin means a polymer including a fluorine atom in the molecule. Specific examples thereof include polytetrafluoroethylene (PTFE), tetrafluoroethylene-perfluoroalkylvinyl ether copolymers (tetrafluoroethylene-perfluoroalkoxyethylene copolymer is referred to as PFA), tetrafluoroethylene-hexafluoropropylene copolymer (FEP), tetrafluoroethylene-ethylene copolymers (E/TFE), polyvinylidene fluoride (PVDF), polychlorotrifluoroethylene (PCTFE), chlorotrifluoroethylene-ethylene copolymers (E/CTFE), tetrafluoroethylene-perfluorodimethyldioxol copolymers (TFE/PDD), and polyvinylfluoride (PVF).

Fluorine-containing resins have good lubricating properties because of having low inter-molecular cohesive energy due to small polarizability of fluorine atom, and a molecular structure in which the molecule chain has smooth surface, and because friction resistance is relaxed by the orientation of the molecules. Therefore, the complex material including PTFE and a fluorine-containing resin is preferably used as the lubricant 22 in the present invention.

EXAMPLE 2

PTFE having a low molecular weight and PTFE having a relatively high molecular weight PTFE are mixed to prepare the lubricant 22. The resultant lubricant 22 has good mechanical strength and an ability to be supplied.

PTFE has good lubricating properties independent of the molecular weight. With respect to the ability to be supplied, low molecular weight PTFE is superior to high molecular weight PTFE. However, high molecular weight PTFE can transfer to the photoconductor 2 and exert its lubricating effects. In addition, since low molecular weight PTFE is dispersed in high molecular weight PTFE, the complex material is easily abraded, and thereby the ability of the lubricant 22 to be supplied to the photoconductor 2 is increased. Therefore, the thus obtained lubricant 22 has good lubricating properties and good ability to be supplied.

A method for molding a complex material of low molecular weight PTFE and high molecular weight PTFE will be mentioned below, but the molding method of a complex material is not limited thereto.

A compression molding method, which can be preferably used for molding of PTFE, will be hereinafter explained. The procedures in the compression molding method (free baking method) are as follows:

(1) a powder mixture of low molecular weight PTFE and relatively high molecular weight PTFE is evenly contained in a mold having a desired shape;

(2) the powder mixture is pressed at room temperature to form a preliminary molding (referred to as a preform), which is still brittle;

(3) the preform is then contained in an oven, heated to a sintering temperature, and kept at a proper temperature, to be sintered; and (4) the sintered preform is cooled at a constant speed to obtain a molding.

When the molding is desired to have an accurate dimension, for example, in making a sheet lubricant, the molding is preferably subjected to secondary treatment such as cutting (for example, skive processing) and the like.

At this point, the molding is carefully performed so that low molecular weight PTFE is not decomposed by heat. When decomposed, bubbles form in the block, resulting in formation of cracks in the block. Therefore, the sintering is preferably performed at a relatively low temperature compared to a sintering temperature for a molding of only high molecular weight PTFE. In addition, the sintering time and the cooling time, and/or the conditions for pressing a preform may be controlled.

Such complex materials have not been used because the mechanical strength of high molecular weight PTFE is decreased by mixing low molecular weight PTFE thereto. However, the complex materials are preferably used as the lubricant 22 in the present invention.

EXAMPLE 3

Low molecular weight PTFE and a tetrafluoroethylene-perfluoroalkyl vinyl ether copolymer (PFA) are mixed to prepare the lubricant 22.

PFA is a random copolymer of tetrafluoroethylene (TFE) and perfluoro(alkyl vinyl ether) (FVE) and has a melting point ranging from 305 to 310° C., which is slightly lower than that of PTFE. In addition, PFA has lower melt viscosity than PTFE. The other properties are similar to those of PTFE.

Since PFA has relatively low melt viscosity compared to PTFE, the complex material can be molded by injection molding methods and extrusion molding methods by which PTFE cannot be molded. A suitable content of low molecular weight PTFE in the complex material is not greater than about 30% when injection molding methods or extrusion molding methods are used.

When the complex material is molded by drawing (such as inflation processing) at a temperature of the melting point of PFA, the resultant film tends to break because low molecular weight PTFE is included therein while PTFE is not melted. By controlling the mixing ratio of low molecular weight PTFE and PFA used, such a problem can be avoided.

This complex material can be molded with an injection molding apparatus by dispersing low molecular weight PTFE in PFA pellets. The molding is generally performed at a temperature of the melting point of PFA, low molecular weight PTFE cannot be decomposed.

Thus, by using a complex material of PFA and low molecular weight PTFE, a lubricant which has good lubricating properties and which can be easily manufactured at a low cost by a conventional molding method such as injection methods can be obtained.

EXAMPLE 4

Low molecular weight PTFE and a tetrafluoroethylene-hexafluoropropylene copolymer (FEP) are mixed to prepare the lubricant 22.

FEP, which is prepared by modifying PTFE with a trifluoromethyl group has relatively low crystallinity and a relatively low melting point ranging from 255 to 265° C., compared to PTFE. Therefore, the complex material can be processed by molding methods in which the material is melted.

A suitable content of low molecular weight PTFE in the complex material is not greater than about 30% when these molding methods are used.

When the complex material is molded by drawing (such as inflation processing) at a temperature of the melting point of FEP, the resultant film tends to break because low molecular weight PTFE is included therein while PTFE is not melted. By controlling the mixing ratio of the low molecular weight PTFE and FEP used, such a problem can be avoided.

This complex material can be molded with an injection molding apparatus by dispersing low molecular weight PTFE in FEP pellets. The molding is generally performed at a temperature of the melting point of FEP, low molecular weight PTFE cannot be decomposed.

Thus, by using a complex material of FEP and low molecular weight PTFE, a lubricant which has good lubricating properties and which can be easily manufactured at a low cost by a conventional molding method such as injection methods can be obtained.

Next, a second embodiment of the image forming apparatus of the present invention will be explained.

The structure of the second embodiment of the image forming apparatus is also shown in FIG. 1. In this image forming apparatus, the target of coefficient of static friction of the surface of the photoconductor 2 is not greater than about 0.4 and preferable from about 0.3 to about 0.1, which is similar to that in the first embodiment of the image forming apparatus mentioned above.

The lubricant 22 includes a fluorine-containing resin and a filler. Suitable fillers for use in the lubricant 22 include materials which control the mechanical strength of the lubricant 22 and the ability of the lubricant 22 to be supplied to the photoconductor 2.

Figures 7A, 7B, 7C:
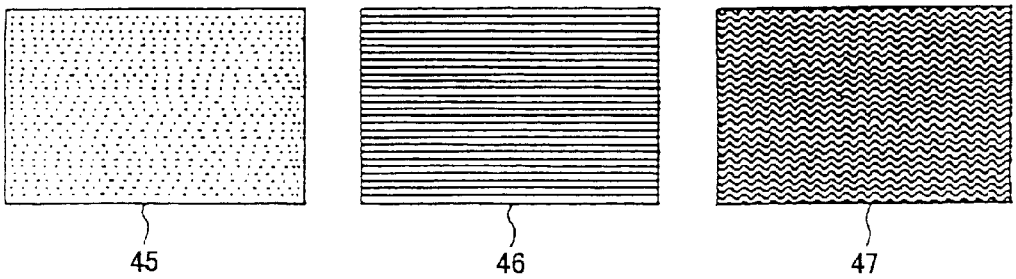
FIGS. 7A–7C are schematic views illustrating embodiments of the lubricant, which includes a filler, for use in the lubricant supplying device of the image forming apparatus of the present invention.

FIGS. 7A–7C illustrate solid lubricants which include a filler therein. FIG. 7A illustrates a solid lubricant 45 in which a powdery filler is dispersed, FIG. 7B illustrates a solid lubricant 46 in which a linear fibrous filler or a flake filler is dispersed in a direction, and FIG. 7C illustrates a solid lubricant 47 in which a curved filler is dispersed like wavy lines.

The lubricant 45 has a mechanical strength which is uniform in every direction. However, the lubricants 46 and 47 have a high elastic property in one direction.

Specific examples of the fillers for use in the lubricant 45 include particulate fillers such as carbon black, silica, calcium carbonate, clay, titanium oxide, magnesium carbonate, glass beads, talc and the like. Fibrous fillers such as glass fiber, carbon fiber, aramid fiber, wollastnite, calcium sulfate and the like are used in the lubricant 46 or 47 depending on their shape. Platy fillers such as mica, graphite, kaolin, glass flake, ferrite and the like are used in the lubricant 46. It is important to select one or more fillers such that the hardness of the fillers is relatively low compared to the material of the image carrier.

One or a combination of these lubricant 45, 46 and 47 is employed depending on the conditions of the image forming apparatus such as materials to be contacted with the lubricant, and the structure of the lubricant 22 and the lubricant supplying mechanism 12. In addition, the material and content of the filler used are also determined depending on the purpose and use of the lubricant.

Figure 8:
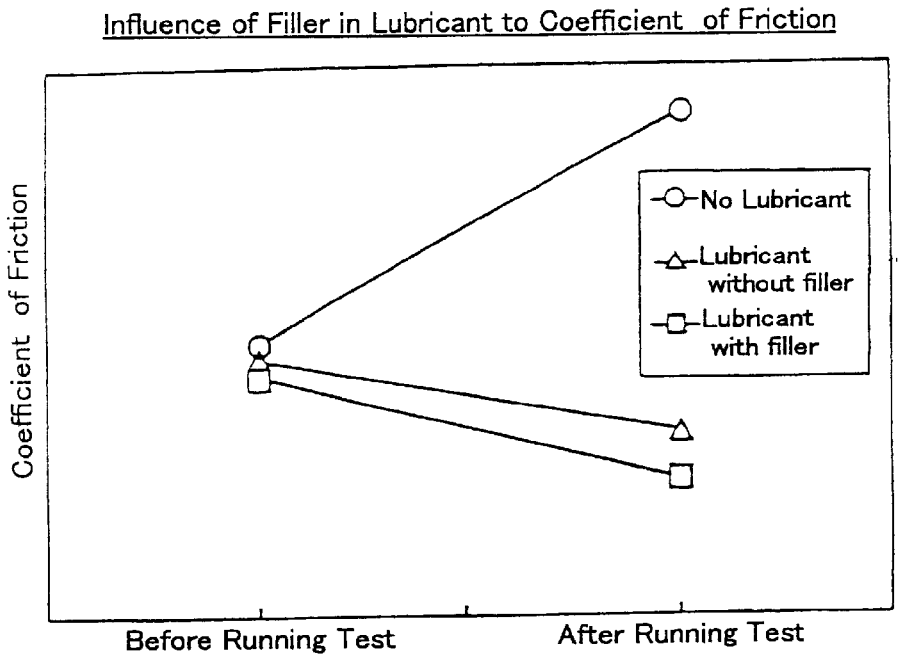
FIG. 8 is a graph illustrating changes of coefficient of friction of an image carrier, which is measured by the apparatus shown in FIG. 4, when the image carrier is subjected to a running test.

FIG. 8 is a graph illustrating changes of the coefficient of friction of the surface of the photoconductor 2 when the lubricant 22 is supplied or is not supplied. The coefficient of friction is measured by the Euler belt method mentioned above. In this test, the lubricant 22 is supplied at a location of the photoconductor 2 after the contacting point of the cleaning blade 14 with the photoconductor 2, but the lubricant 22 can be supplied at any location of the photoconductor 2.

As can be understood from FIG. 8, the coefficient of friction, $\mu$, of the surface of the photoconductor 2 increases when the photoconductor 2 is run without supplying the lubricant 22. However, when the photoconductor 2 is run while supplying a lubricant, the coefficient of friction, $\mu$, decreases after the running test. In addition, when the photoconductor 2 is run while supplying a lubricant including a filler, the coefficient of friction, $\mu$, after the running test is slightly smaller than that in the case using the lubricant without the filler. The coefficient of friction falls in the targeted range of the coefficient of friction in the present invention when the lubricant with or without the filler is used.

Figure 9:
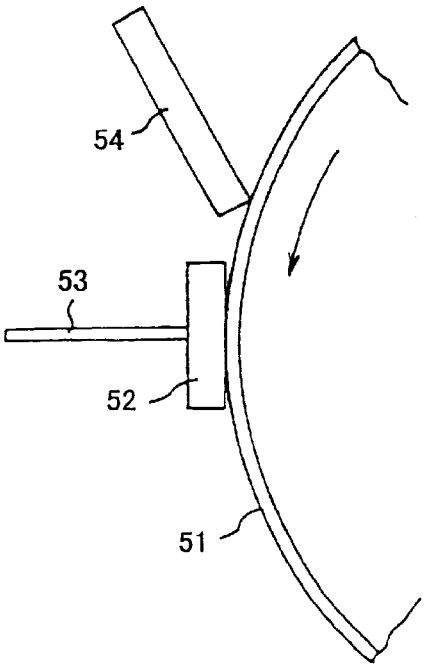
FIG. 9 is a schematic view illustrating another embodiment of the lubricant supplying device of the image forming apparatus of the present invention.

The lubricant 22 may be supplied to the photoconductor 2 by the supplying brush 26 as shown in FIGS. 1 to 3. Alternatively, as shown in FIG. 9, a lubricant 52 may be directly supplied to a photoconductor 51 while being supported by a supporter 53 and pressed to the photoconductor 51. In addition, when a lubricant, which does not uniformly transfer to the photoconductor 51, is used as the lubricant 52, the lubricant 52 may be uniformly applied to the photoconductor 51 using the pressure of the cleaning blade 54.

Suitable materials for use as the lubricant 52 include fluorine-containing resins. Among the fluorine-containing resins, PTFE is more preferable. Fluorine containing-resins have good heat resistance, good resistance to chemicals and good electric insulating properties, and in addition, they have good lubricating properties. PTFE having various shapes such as sheets, tapes and powders are practically used in market, and therefore, a PTFE material suitable for the lubricant supplying device used can easily be selected. Specific examples of such PTFE materials include tape-shaped materials such as Teflon tapes, Naflon tapes, and Nitoflon tapes; film-shaped materials such as Nitoflon sheets, FEP, Naflon sheets and Fluoroglass sheets; and powders such as Rubron, KTL and Modiper (these are Tradenames).

In addition, liquid fluorine-containing materials such as fluorocarbon oils, perfluoro ether oils, and fluorine-containing greases including the oils mentioned above as a basic oil can also be used.

The fluorine-containing resins are not limited thereto, and any one of PTFE can be used.

PTFE has low hardness, i.e., low mechanical strength. As mentioned above, the mechanical strength can be enhanced by adding a filler therein. By adding a filler in PTFE, PTFE further has the following advantages:

(1) hardness is improved and the elastic modulus can also be improved;

(2) resistance to compression and creep can be improved;

(3) good thermal properties such as low thermal expansion coefficient at high temperatures and large heat conductivity can be obtained; and (4) abrasion resistance is good.

In the present invention, the lubricant 22 preferably includes PTFE including a filler because the lubricant 22 is used for image forming apparatus such as copiers and printers in which abrasion resistance of the lubricant 22 is needed. Moldings including PTFE and a filler are prepared, for example, by the following compression molding method (free baking method):

(1) a powder mixture of low molecular weight PTFE and a filler such as titanium oxide in a weight ratio of 10:1 is evenly contained in a mold having a desired shape;

(2) the powder mixture is pressed at room temperature to form a preliminary molding;

(3) the preliminary molding is then contained in an oven, heated to a sintering temperature and then kept at a proper temperature, to be sintered; and (4) the sintered molding is cooled at a constant speed to prepare a molding.

In the present invention, fillers are employed alone or in combination. Specific examples of such fillers include inorganic fillers such as glass fiber, carbon fiber, graphite, molybdenum disulfide, bronze, aluminum silicate, talc, and metal oxides; heat resistant organic polymers such as polyimide resins, aromatic polyester resins, and polyphenylene sulfide resins. By including one or more these fillers, PTFE is improved in the properties such as abrasion resistance and creep, bending elastic modulus, hardness, heat conductivity, coefficient of linear expansion and the like.

With respect to abrasion resistance, glass fiber is preferable, however, the glass fiber has high hardness and therefore tends to shave materials which contact the glass fiber. In this case, the addition content of glass fiber is decreased, or graphite or bronze is alternatively employed.

Graphite and carbon fiber tend to be easily divided, however, they improve the lubricating properties. Graphite decreases starting friction and improves resistance to cold flow. However, the abrasion resistance of graphite or carbon fiber is slightly inferior to glass fiber. With respect to abrasion resistance, amorphous carbon is better than graphite. Therefore, graphite may be used in combination with carbon. Molybdenum disulfide has good resistance to cold flow and good lubricating properties. However, the abrasion resistance of molybdenum disulfide is not so good, it is preferable to use molybdenum disulfide together with glass fiber.

Self-lubricating materials can be also used as a filler.

Specific examples of self-lubricating materials include the following materials but are not limited thereto:

(1) Solid Self-lubricating Materials

Metal salts of fatty acids such as lead oleate, zinc oleate, copper oleate, zinc stearate, cobalt stearate, iron stearate, copper stearate, zinc palmitate, copper palmitate, and zinc linolenate; talc compounds; fluorine-containing resins such as PTFE, polychlorotrifluoroethylene, polyvinylidene fluoride, polydichlorodifluoroethylene, tetrafluoroethylene-ethylene copolymers, and tetrafluoroethylene-hexafluoropropylene; waxes such as carnauba wax; and the like.

(2) Liquid Self-lubricating Materials

Synthetic oils such as silicone oils and fluorine-containing oils; animal oils such as squalane oil; vegetable oils such as rape oil; mineral oils; and the like. From the view point of long term stability, synthetic oils such as silicone oils and fluorine containing oils are preferable.

Since a part of the lubricant 22 which adheres to the photoconductor 2 is transferred to a receiving paper as a part of an image, the filler included in the lubricant 22 is preferably white, and more preferably colorless.

Specific examples of the white fillers include alumina, kaolin clay, fine silicic acid, calcium silicate, magnesium carbonate, titanium oxide, magnesium hydroxide, aluminum hydroxide, quartz powder, calcium carbonate, magnesium carbonate, feldspar powder, baryta, whiting, agalmatolite clay and anhydrous gypsum. These filler are used alone or in combination.

Specific examples of colorless fillers include glass materials such as glass beads and glass flakes; and beads of polymers such as polystyrene, methyl methacrylate and the like.

A third embodiment of the present invention will be hereinafter explained with reference to FIG. 10.

Figure 10:
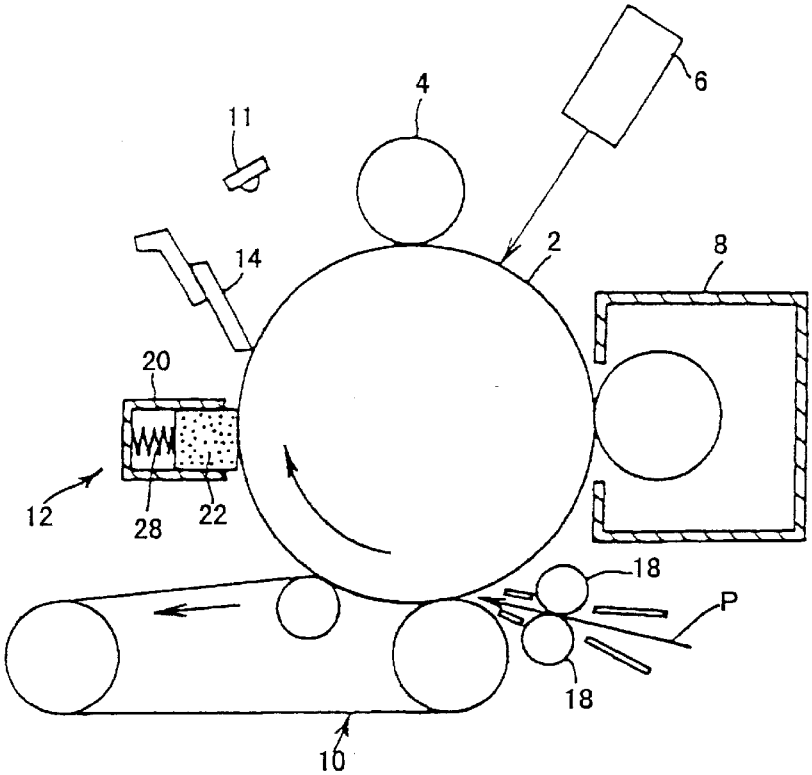
FIG. 10 is a schematic side view illustrating a primary part of yet another embodiment of the image forming apparatus of the present invention.

FIG. 10 is a schematic view illustrating a primary part of the third embodiment of the image forming apparatus of the present invention. The difference between the apparatus shown in FIG. 10 and the apparatus shown in FIG. 1 is that the lubricant supplying device 12 directly supplies the lubricant 22 to the photoconductor 2 in FIG. 10. The members other than the lubricant supplying device 12 are the same as those in FIG. 1, only the lubricant supplying device 12 will be hereinafter explained.

The lubricant supplying device 12 includes a case 20 which is disposed on a fixed member (not shown in FIG. 10) of the apparatus, a lubricant 22 which is shaped like a rectangular prism and which is movably contained in the case 20, and a spring 28 which presses the lubricant 22 to the surface of the photoconductor 2. Since the lubricant 22 is pressed to the photoconductor 2 with the spring 28, the thickness of the lubricant 22 gradually decreases and almost all the lubricant 22 can be exhausted.

The lubricant 22 may be supplied by the indirect supplying methods as shown in FIGS. 1 and 2, in which the lubricant 22 is supplied to the photoconductor 2 with the lubricant supplying brush 26 after being transferred to the supplying roller 24 and then to the supplying brush (rotating brush) 26, or after being transferred to the supplying brush (rotating brush) 26.

Figure 11:
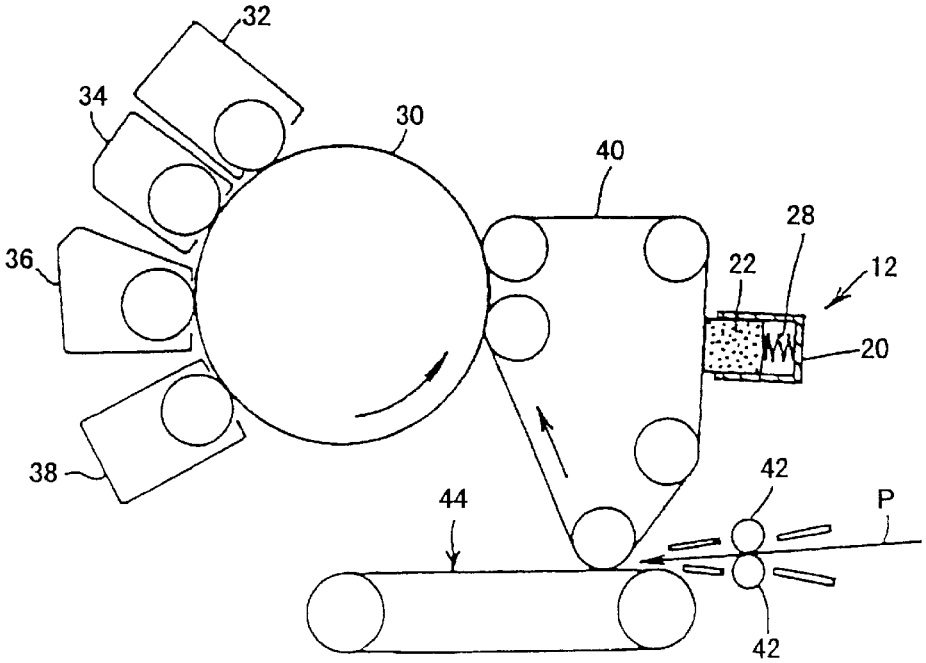
FIG. 11 is a schematic side view illustrating a primary part of still another embodiment of the image forming apparatus of the present invention, which includes an intermediate transfer belt as an image carrier.

In addition, the member to which the lubricant 22 is to be supplied is not limited to the photoconductor 2 and may be an intermediate transfer belt. An image forming apparatus of the present invention including an intermediate transfer belt is shown in FIG. 11. The image forming apparatus is the same as that shown in FIG. 3 except that a lubricant supplying device 12 directly supplies a lubricant 22 to an intermediate transfer belt 40 in FIG. 11. In FIG. 11, the lubricant supplying device may be the indirect lubricant supplying devices as described above.

Even in the third embodiment of the image forming apparatus of the present invention, the coefficient of friction of the intermediate transfer belt 40 (or photoconductor 2) is preferably not greater than about 0.4, and more preferably from about 0.3 to about 0.1.

Suitable materials for use as the lubricant 22 in the lubricant supplying device 12 include low molecular weight PTFE. Since the low molecular weight PTFE is explained above for use in the first embodiment of the image forming apparatus of the present invention, an image forming apparatus using a lubricant including low molecular weight PTFE which is prepared by a heat decomposition method or a radiation decomposition method is hereinafter explained.

At first, low molecular weight PTFE which is prepared by a heat decomposition method.

PTFE has high heat stability and a weight loss is observed at a general molding temperature. The molding temperature of PTFE is about 400° C. or lower. When PTFE is heated at a temperature higher than the molding temperature, weight is gradually decreased, which is caused by heat decomposition of PTFE. This heat decomposition is accelerated at a temperature higher than about 500° C. Therefore low molecular weight PTFE can be obtained by appropriately heating PTFE. Therefore, by heating PTFE at an appropriate temperature, low molecular weight PTFE can be obtained.

PTFE moldings are prepared, for example, by a free baking method of the compression molding method in which a preliminary molding is prepared and then in an oven heated at 370–380° C. if the molding is small. When the molding is relatively large, the preliminary molding is firstly set in an oven and then the oven is heated to 360 to 380° C.

PTFE moldings can also be prepared by a ram extrusion molding method such that the maximum sintering temperature does not exceed 400° C. (when processing pipe materials), or by a paste extrusion molding method such that the maximum sintering temperature is in a range of from 360 to 400° C. If a metal wire is used in the center of the paste in the paste molding method, the temperature is often set at a temperature higher than 400° C. because the metal wire absorbs heat.

In the present invention, low molecular weight PTFE moldings are prepared by a heat decomposition method such that the maximum sintering temperature is higher than 400° C. (hereinafter referred to superheating) without using a metal wire. At this point, low molecular weight PTFE is not necessarily prepared at 400° C., i.e., the superheating temperature of the superheating operation is not limited to 400° C. The superheating temperature means a temperature at which PTFE is heat-decomposed and which is higher than the temperature at which molding operations of PTFE are generally performed.

The heating conditions such as the superheating temperature and the sintering time are determined depending on the size of the moldings (the lubricant 22) and the like.

By using the low molecular weight PTFE which is prepared by the heat decomposition method in the molding process, the effects of low molecular weight PTFE, which is mentioned above in the first embodiment of the present invention, can also be exerted.

By performing the heat decomposition operation during the molding operation, a low molecular weight PTFE molding can be easily prepared without performing an additional heat decomposition process.

The specific gravity of the samples (PTFE) which are decomposed by the method mentioned above is shown in Table 1. The specific gravity is a proxy of the molecular weight of PTFE.

As can be understood from Table 1, the specific gravity increases as PTFE is decomposed.

TABLE 1

| | Ordinal processing | PTFE decomposed by the method (1) | PTFE decomposed by the method (2) |
|---|---|---|---|
| Specific gravity (g/cc) | 2.170 | 2.226 | 2.209 |

The decomposition method (1) is the following.

The heat decomposition operation of PTFE is performed after the molding operations have been finished. When a molding is excessively superheated during the molding operations, gases which are generated during the sintering operations and which are caused by the heat decomposition form bubbles in the molding, resulting in deterioration of mechanical strength of the resultant molding. Therefore, it is preferable to superheat the molding after the molding is sintered. For example, in a case in which a block is prepared by an ordinary compression molding method, and then a sheet is prepared by cutting the block, by ordinary operations, the molecular weight of the resultant sheet can be decreased when the sheet is superheated, and therefore the specific gravity thereof increases. As can be understood from Table 1, the superheated sheet has a specific gravity greater than the sheet which is prepared by ordinal processing. By the heat decomposition method, low molecular weight PTFE moldings can easily prepared without complicated operations.

The decomposition method (2) is the following.

In method (2), PTFE is decomposed by radiation to form low molecular weight PTFE. As mentioned before, PTFE is a radiation-decomposing polymer. Suitable radiation useful for decomposing PTFE includes known radiation such as γ ray, electron beams and the like. The molecular weight of PTFE can be controlled by changing the intensity of the energy of the radiation used and the radiation time. As can be understood from Table 1, the radiation-decomposed PTFE has a specific gravity greater than ordinarily prepared PTFE. Thus, low molecular weight PTFE can be prepared by the radiation decomposition method.

The radiation decomposition operation can be performed during the molding operations which include compression molding operations and secondary operations such as cutting and the like. Compression molding methods are generally used for preparing sheets. Radiation decomposition operations can be performed at any time of the molding operations. For example, radiation may be irradiated to PTFE at an initial stage, such as compression molding operation, of the molding operations, or at a final stage, such as cutting operation, of the molding operations.

Hereinafter, an example in which a PTFE block which has been prepared by a compression molding and which is not subjected a cutting operation is exposed to radiation will be explained. The block is contained in a radiation radiating apparatus and then γ ray is radiated to the block to cut the C—C bonding of PTFE, resulting in formation of low molecular weight PTFE. Since the entire block achieves low molecular weight, a sheet having low molecular weight can be easily prepared by the following cutting operation.

The molecular weight of the resultant PTFE molding can be controlled by changing the intensity of the radiation used and the radiation time.

Radiation decomposition operations may be performed after the molding operations of the lubricant 22 are finished. When radiation decomposition operations are performed during sintering operations of a molding, there is a case in which it is difficult to perform the following operations. For example, when a block is prepared by a compression molding method while radiation decomposition is excessively performed, bubbles tend to form in the resultant block, which is caused by gases generated by the decomposition of the material, resulting in deterioration of the mechanical strength of the resultant block, or acceleration of crystallization of the block, and thereby cracks are formed in the resultant block. Thus, the block cannot be subjected to the secondary treatment such as cutting.

In order to avoid such a problem, radiation decomposition operations are preferably performed after these molding operations are finished. For example, when a sheet which is ordinary prepared by cutting a block is subjected to radiation treatment, the C—C bonding of PTFE is cut, resulting in formation of low molecular weight PTFE.

The molecular weight of the resultant low molecular weight PTFE can also be controlled by changing the intensity of radiation used and radiation time.

Thus, a lubricant of low molecular weight PTFE which has various advantages mentioned before can be prepared.

Next, a fourth embodiment of the image forming apparatus of the present invention will be explained.

Figure 12:
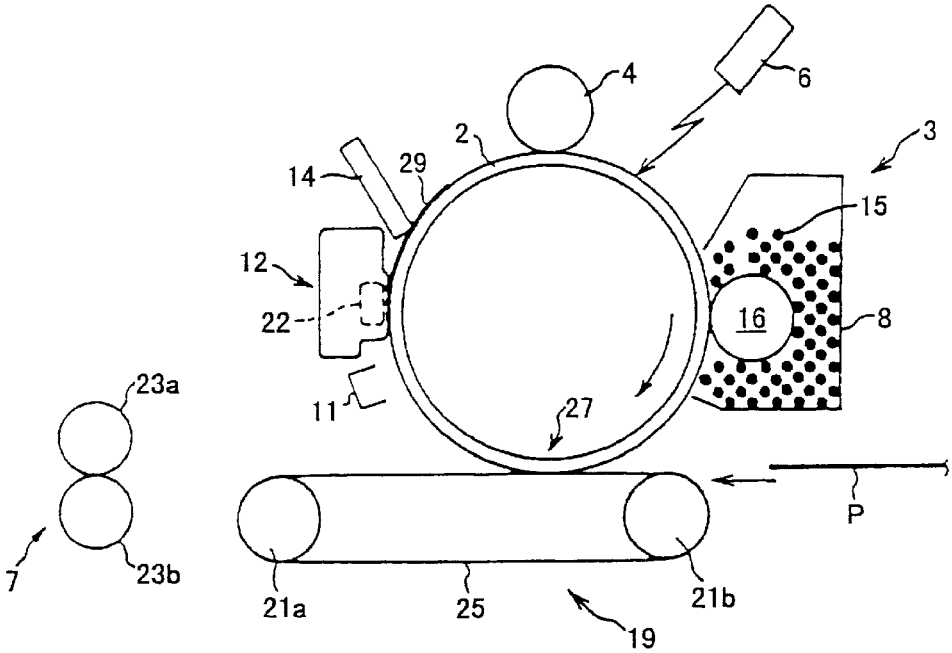
FIG. 12 is a schematic side view illustrating a primary part of a further embodiment of the image forming apparatus of the present invention.

FIG. 12 is a schematic view illustrating a primary part of the fourth embodiment of the image forming apparatus of the present invention. This image forming apparatus is basically the same as the image forming apparatus shown in FIGS. 1 and 10 except that the lubricant supplying device 12 is modified so that a compression molded fluorine-containing resin is supplied as the lubricant 22.

In FIG. 12, a drum-shaped photoconductor 2 serving as an image carrier is rotated in the clockwise direction, and then uniformly charged with a charging device 4. A laser beam which is modulated by image data irradiates the photoconductor 2 with an exposing unit 6 to form an electrostatic latent image thereon. The latent image formed on the photoconductor 2 is developed with a developer 15 which includes a toner and which is contained in a developing unit 8 of a developing device 3 and supplied to the photoconductor 2 with a developing roller 16, resulting in formation of a toner image on the photoconductor 2. The toner image on the photoconductor 2 is then transferred onto a receiving paper P at a transferring area 27 which is formed by the photoconductor 2 and a transfer device 19 and which is located downstream from the developing device 3 with respect to the rotating direction of the photoconductor 2. The transfer device 19 includes a driving roller 21*a* and an idler roller 21*b*, and a transfer belt 25 which is wound around the driving roller 21*a* and the idler roller 21*b*. The receiving paper P having the transferred toner image is fed to a fixing device 7 having a fixing roller 23*a* and a heat roller 23*b* by the transfer device 19 to fix the toner image on the receiving paper P. The receiving paper P is then discharged to a tray (not shown).

The photoconductor 2 is discharged with a discharger 11 after the toner image transferring operation, and the residual toner remaining on the surface of the photoconductor 2 is cleaned with a cleaning blade 14 which contacts with pressure the surface of the photoconductor 2. The cleaned photoconductor 2 is subjected to the next cycle of the image forming processes. A lubricant supplying device 12, which supplies a lubricant 22 which is compression molded and which includes a fluorine-containing resin, is provided on the surface of the photoconductor 2 at a location between the discharger 11 and the cleaning blade 14. When the lubricant 22 is applied on the photoconductor 2, a lubricant layer 29 is formed thereon. The target value of the coefficient of friction of the surface of the photoconductor 2, which is measured by Euler belt method, is not greater than about 0.4 and preferably from about 0.3 to about 0.1. Preferably the lubricant 22 include PTFE. This is because PTFE has the lowest coefficient of friction among solids, and the surface of the molecule is smooth, and thereby the coefficient of friction of the surface of the photoconductor 2 is drastically decreased when PTFE is applied thereon. In addition, the lubricant 22 may include a filler when abrasion resistance of the lubricant 22 is particularly needed.

The compression molded PTFE for use as the lubricant 22 is prepared, for example, by the following method:

(1) a PTFE powder is contained in a mold having a desired shape; and (2) the PTFE powder is pressed at a pressure of from 100 to 1000 kg/cm$^2$ at room temperature.

Figure 13:
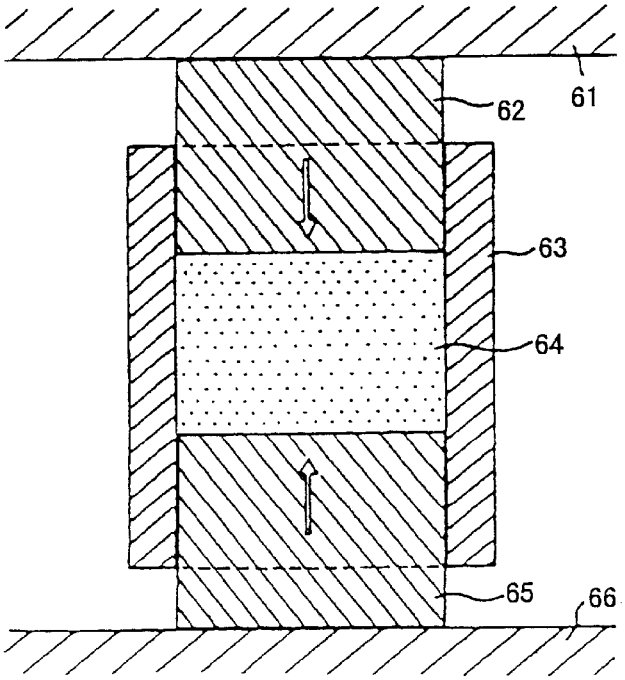
FIG. 13 is a schematic cross section illustrating a compression molding operation of polytetrafluoroethylene.

FIG. 13 is a schematic view illustrating how the compression molded PTFE is prepared. A PTFE powder 64 which is uniformly contained in a mold 63 is molded by being pressed in a direction shown by arrows using an upper plunger 62 and a lower plunger 65. Numerals 61 and 66 denote pressing members of a pressing machine. In order to obtain good molding without cracks, the number average molecular weight of PTFE is preferably from about 5 million to about 6 million.

In addition, in order to avoid generation of voids in the resultant molding, it is important to pay attention to the following matters:

(1) the raw powder of PTFE is uniformly dispersed in the mold 63 after the particles of the powder are disaggregated; and (2) the pressing operation is gradually performed so as to remove air between the particles of the powder.

In order to avoid the generation of voids, the particle diameter of the raw powder is preferably small and uniform, and the pressure of the compression molding is preferably high.

The moving speed of the plungers 62 and 65 is initially from 30 to 50 mm/min, and a few mm/min at a final stage of the compression molding. The larger the size of the resultant molding, the slower the moving speed of the plungers should be. Preferred pressure in the compression molding operation is generally from 100 to 350 kg/cm$^2$, and when the raw material to be molded includes a filler, the pressure is preferably from 300 to 1000 kg/cm$^2$. The powder is maintained at the predetermined pressure for a few to tens minutes to avoid generation of voids. When a large size molding is prepared, the plunges 62 and 65 slightly move for about 15 minutes even when the pressure is maintained, and therefore the pressing time is preferably from about 20 to 30 minutes. When the powder is heated, a molding having a relatively high density can be obtained at a relatively low pressure and a molding having few voids therein can be obtained.

The crystallinity of the resultant molded PTFE depends on the molding conditions, especially to sintering conditions and more especially to the cooling speed. The faster the cooling speed, the smaller the crystallinity of the resultant molded PTFE. When the resultant molded PTFE has a relatively large crystallinity, the stiffness increases, and in contrast when the resultant molded PTFE has a relatively small crystallinity, the toughness and transparency increases.

Thus, by using a compression molding method, a PTFE molding having few voids can be prepared by controlling only the pressure, and in addition, the resultant molding has the same size as that of the mold. In the compression molding method, a molding can be prepared without a sintering operation.

Suitable materials for use as the compression molded lubricant 22 include a material in which PTFE and low molecular weight PTFE is mixed. This is because the resultant lubricant 22 has good mechanical strength and good ability to be supplied to the image carrier, and can impart the surface of the image carrier low coefficient of friction.

As mentioned before, low molecular weight PTFE has good ability to be supplied to the image carrier, however it has poor molding properties. When the molecular weight of PTFE increases, the mechanical strength is improved. Therefore it is preferable to include low molecular weight PTFE in relatively high molecular weight PTFE when a molding of PTFE is prepared by a compression molding method. When low molecular weight PTFE is mixed together with another material, it is preferable to mix them while applying large shear strength to uniformly disperse the low molecular weight PTFE.

Specific examples of such low molecular weight PTFE include tradenamed Rubron L-2 and L-5 manufactured by Daikin Co., Ltd., Teflon TLP10F and MP1300 manufactured by Du Pont-Mitsui Fluorochemicals Co., Ltd., and Fluon L-150J and L-169J manufactured by Asahi Glass Co., Ltd. and Asahi-ICI Fluoro Polymer Co., Ltd. These materials have different dispersing properties, lubricant properties, resistant to abrasion, heat stability, particle size, distribution of particle size, and surface areas, and therefore a material suitable for the purpose of the lubricant can be selected from these materials. From the view point of dispersion, Rubron L-2 is preferable.

In FIG. 12, the lubricant supplying device 12 is disposed at a location upstream from the cleaning blade 14. The lubricant applied to the photoconductor 2 is rubbed by the cleaning blade 14, and therefore the applied lubricant can be securely adhered to the photoconductor 2.

Figure 14:
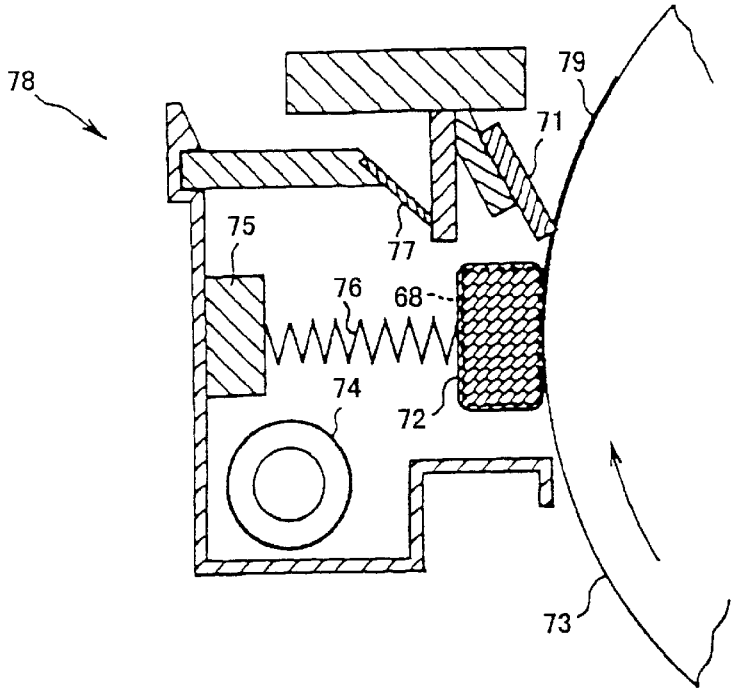
FIG. 14 is a schematic enlarged view illustrating yet another embodiment of the lubricant supplying device of the image forming apparatus of the present invention.
Figure 15:
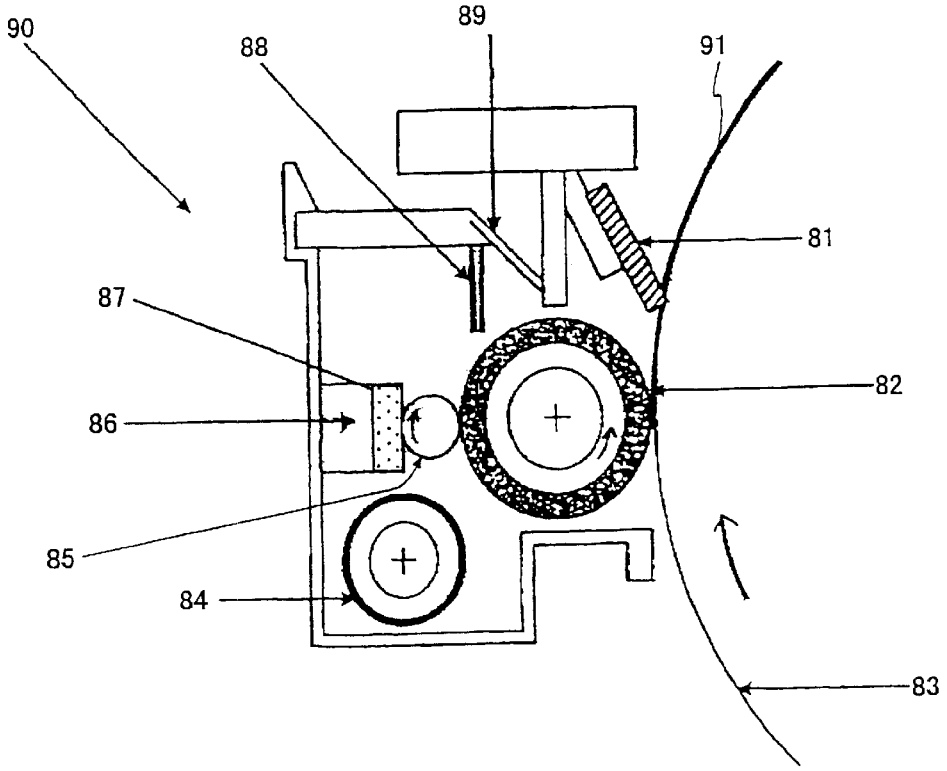
FIG. 15 is a schematic enlarged view illustrating still another embodiment of the lubricant supplying device of the image forming apparatus of the present invention.

In addition, in order to allow the lubricant 22 to securely adhere to image carrier, a sliding blade member 71 or 81 shown in FIG. 14 or 15 may be disposed.

An embodiment of the image forming apparatus of the present invention includes a lubricant supplying device 78 as shown in FIG. 14. The lubricant supplying device 78 includes a blade 71 which contacts a photoconductor 73 and which scrapes a residual toner on the photoconductor 73, a roller 74 which collects the residual toner, a net bag 72 containing a lubricant 68 including a compression molded PTFE, a coil spring 76 which presses the net bag 72 with appropriate pressure, a spring supporter 75 which supports the coil spring 76, and a seal 77 which seals an entrance of the lubricant supplying device 78 to prevent toner scattering. The blade 71 contacts the photoconductor 73 at a location downstream from a point, at which the net bag 72 contacts the photoconductor 73, with respect to the rotating direction of the photoconductor 73.

As shown in FIG. 14, the lubricant supplying device 78 brings the net bag 72 containing the lubricant 68 into contact with the photoconductor 73, which rotates in the clockwise direction, while pressing with appropriate pressure by the coil spring 76. Thus, the lubricant 68 transfers onto the photoconductor 73 through the net of the net bag 72. The lubricant adhered to the photoconductor 73 is securely fixed with the pressure of the blade 71, resulting in formation of a lubricant layer 79 of the lubricant 68, i.e., PTFE, on the photoconductor 73. Since the lubricant 68 is contained in the net bag 72, even a relatively brittle lubricating material can be used as the lubricant 68.

A lubricant supplying device 90 as shown in FIG. 15 can also be used for the image forming apparatus of the present invention. The lubricant supplying device 90 includes a blade 81 which contacts a photoconductor 83 and which scrapes a residual toner on the photoconductor 83 while sliding, a roller 84 which collects the residual toner, a flicker 88 which regulates the collected toner, a supporting member 86 which securely supports a lubricant 87 including a compression molded PTFE, a lubricant supplying brush 82 which contacts the photoconductor 83 to supply the lubricant 87 thereto, a lubricant supplying roller 85 which contacts the lubricant 87 and the lubricant supplying brush 82 and which scrapes the lubricant 87 to supply the lubricant 87 to the lubricant supplying brush 82, and a seal 89 which seals an entrance of the lubricant supplying device 90 to prevent toner scattering. The blade 81 contacts the photoconductor 83 at a location downstream from a point, at which the lubricant supplying brush 82 contacts the photoconductor 83, with respect to the rotating direction of the photoconductor 83.

In the lubricant supplying device 90, the lubricant 87 is scraped by the lubricant supplying roller 85 which rotates clockwise, and the lubricant 87 is then transferred to the lubricant supplying brush 82 which rotates counterclockwise. The lubricant 87 on the lubricant supplying brush 82 is transferred onto the surface of the photoconductor 83 which rotates clockwise. The lubricant 87 transferred on the photoconductor 83 is securely fixed to the photoconductor 83 by the pressure of the blade 81, resulting in formation of a lubricant layer 91 on the photoconductor 83.

When a compression molded lubricating material which is used as the lubricant 87 is too soft, the lubricant supplying device 90 is more preferable than the direct lubricant supplying method, because any one of the lubricant supplying roller 85 or the lubricant supplying brush 82 may be used to supply the lubricant 87 to the photoconductor 83. However, it is preferable to use both the lubricant supplying roller 85 and the lubricant supplying brush 82 because the lubricant 87 can be uniformly applied on the photoconductor 83. In addition, these indirect lubricant supplying methods have the following advantages:

(1) various materials can be used as the lubricant 87 with respect to the hardness, i.e., even a hard material or a soft material can be used as the lubricant 87;

(2) the lubricant 87 can be disposed in the apparatus with greater freedom; and (3) a uniform lubricant layer can be formed on an image carrier.

When the lubricant supplying device 78 or 90 is used, a known cleaning roller can be used instead of the cleaning blade 14 as shown in FIG. 12 because the blade 71 or 81 can scrape a residual toner. When the cleaning blade 14 and the lubricant supplying device 78 or 90 is used, the blade 71 or 81 may be omitted. In addition, when the cleaning blade 14 and the lubricant supplying device 78 or 90 is used, the pressure of the blades 14, and 71 or 81 can be decreased, resulting in decrease of abrasion of the photoconductor 83.

Hereinbefore the image carrier is explained limiting to the drum-shaped photoconductor 2, 73 or 83, but the image carrier is not limited thereto, and other image carriers such as photoconductors having another shape, intermediate transfer belts and the like can also be used.

As the fifth embodiment of the present invention, porous fluorine-containing resins are used as the lubricant in the lubricant supplying device.

The porous fluorine-containing resins serving as a lubricant is used for the lubricant supplying device as shown in FIG. 12, but is not limited thereto. In FIG. 12, the lubricant supplying device 12 contacts the photoconductor 2 at a location downstream from the discharger 11 and upstream from the cleaning blade 14 with respect to the rotating direction of the photoconductor 2. However, in the fifth embodiment, the lubricant supplying device 12 is disposed at a location on the photoconductor 2 downstream from the cleaning blade 14 and upstream from the charger 4. The image forming processes are the same as those in the fourth embodiment, and therefore the explanation of the image forming processes are omitted here.

In the fifth embodiment of the image forming apparatus of the present invention, the target value of coefficient of friction of the photoconductor 2, which is measured by the Euler belt method, is also not greater than about 0.4 and more preferably from about 0.3 to about 0.1.

Hereinafter the method for preparing a porous fluorine-containing resin will be explained.

As for the molding method of porous fluorine-containing resin, the following methods can be used:

(A1) a method using a hole making agent;

(A2) a method in which a porous resin is made from a fibrous fluorine-containing resin; and (A3) a method in which a porous resin is made by drawing treatment.

In the method A1, a fluorine-containing resin and a hole making agent are mixed, and then subjected to a preliminary molding operation and a sintering operation. In the preliminary molding operation or the sintering operation, or after the sintering operation, the hole making agent is removed therefrom to form a porous resin. Suitable hole making agents useful for making porous resins include inorganic salts which have good resistance to heat of the sintering operation and which dissolves to water or solvents. In this case, the hole making agent is removed from the molding by dipping into water or other solvents. Alternatively, materials such as acrylic resins, which can be removed in the sintering operation, can also be used as the hole making agent.

In the method A2, a paper-like porous material which is prepared by dispersing in water a fibrous fluorine-containing resin, or a textile of a fibrous fluorine-containing resin is molded to form a porous resin. The fibers of the resin adhere with each other by being heated and therefore the fibers are not disentangled.

In the method A3, a paste of a fluorine-containing resin is extruded and then subjected to calender treatment to form a sheet. Then the sheet is drawn to form a porous sheet. The size of the resultant holes can be controlled by the ratio of drawing. By the method A3, the resultant holes have a narrow diameter distribution compared to the methods A1 and A2.

The porous fluorine-containing resin preferably includes PTFE which may include a filler mentioned above for use in the second embodiment. Suitable materials for use as PTFE include a mixture of relatively low molecular weight PTFE and relatively high molecular weight PTFE.

A method for preparing the porous PTFE is the following, but is not limited thereto.

PTFE, and a filler, if necessary, are contained in a container, and then a mixture of a hole making agent, and an additive, which serves as a lubricant when performing paste extrusion, such as solvent naphtha or kerosene is added to the container to prepare a raw composition. In this case, the container is closed with a cap. The addition amount of the additive should be controlled so that extrusion operation can be smoothly performed and the resultant molding has a desired shape. In addition, the hole making agent preferably has a compatibility with the additive, and thermal properties such that it does not evaporate at a low temperature and easily evaporate at a temperature of the sintering temperature of PTFE without changing its color. In this case, suitable materials for use as the hole making agent include silicone oils. The addition amount of the hole making agent should be controlled so that the resultant PTFE molding has desired holes and does not have a crack.

The container containing the raw composition is agitated with a roll mixer and then aged at room temperature. The agitating time should be controlled so as not to form secondary particles. The aged raw composition is then agitated again with a roll mixer, and contained in a mold while applying pressure to prepare a preliminary molding. The resultant preliminary molding is then contained in a paste extruder and extruded to form a molding. The resultant molding is dried at room temperature to remove the additive therefrom. In addition, in order to perfectly remove the additive, the molding is dried in an oven at a relatively low temperature. Further, the molding is heated, and sintered while being kept at a sintering temperature. At this point, the molding is melted and the hole making agent (silicone oil) evaporates, resulting in formation of a porous material. The porous material is cooled in the air or water to form a desired porous fluorine-containing material.

Figure 16A:
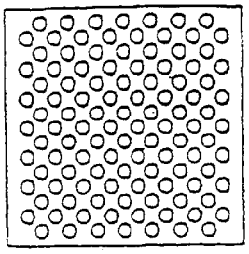
FIGS. 16A and 16B are schematic views illustrating the structures of porous lubricants for use in the lubricant supplying device of the image forming apparatus of the present invention.
Figure 16B:
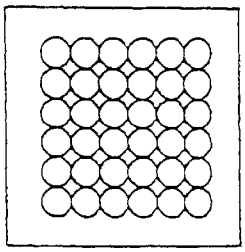

The porous material may be a porous material in which each hole is formed independently of the other holes as shown in FIG. 16A, or a porous material in which holes are continuously formed as shown in FIG. 16B.

The porous lubricant has the following advantages:

(1) the porous lubricant is relatively soft, and therefore hardly damages an image carrier even when supplied by a direct supplying method;

(2) the porous lubricant is relatively soft, and therefore the lubricant is rapidly supplied to an image carrier if desired; and (3) the amount to be supplied to an image carrier can be controlled so as to be relatively low compared to a case using a solid lubricant.

The porous lubricant may include a liquid lubricant in the holes. Conventionally an oil is supplied to, for example, a fixing unit in an image forming apparatus, however a plurality of parts are needed for an oil supplying device. In contrast, the porous lubricant including a liquid lubricant can supply a lubricant to an image carrier without providing a complicated device.

A porous lubricant including a liquid lubricant is prepared, for example, by the following method.

A liquid lubricant is contained in a bath, and then heated to a predetermined temperature (typically about 100° C.). A porous lubricant is dipped in the bath to contain the liquid lubricant therein. The bath is cooled to room temperature and the porous lubricant is taken out of the liquid lubricant. Thus, a porous lubricant including a liquid lubricant can be prepared.

Suitable lubricants for use as the liquid lubricant include lubricating oils. Lubricating oils include specified fractions of petroleum and synthetic oils, each of which is mixed with one or more additives. The lubricant oils have advantages in that oils having various viscosity can be used as a basic oil and various additives can be included therein.

Specific examples of such basic oils for use in the lubricating oils include mineral oils such as naphthene oils and paraffin oils, and synthetic oils such as ester oils and silicone oils. In the present invention, any oils can be used if the oils do not change their properties, and do not evaporate at a sintering temperature of the porous lubricant.

In addition, the porous lubricant may include a solid lubricant in their holes. In this case, the solid lubricant means lubricating materials which are soft and easily slips by a shearing force. Specific examples of such solid lubricating materials include compounds, which can form a solid layer, such as molybdenum disulfide, graphite, and boron nitride; metal soaps such as metal salts of stearic acid, and metal soaps such as metal salts of oleic acid; waxes such as carnauba wax, and bees wax; various kinds of polymers; and the like. These solid lubricating materials can be used alone or in combination.

A porous lubricant including a solid lubricating material is prepared, for example, by the following method.

A solid lubricating material is heated to be melted. The melted lubricating material is contained in the holes of the porous lubricant, for example, by dipping the porous lubricant in the melted lubricating material.

The thus prepared porous lubricant including a liquid lubricant or a solid lubricant therein is preferably used by directly contacting to an image carrier. Since the number of parts of the lubricant supplying device can be reduced, the manufacturing costs of the lubricant supplying device can be reduced.

FIGS. 17 to 20 are lubricant supplying devices in which the porous lubricant is used.

Figure 17:
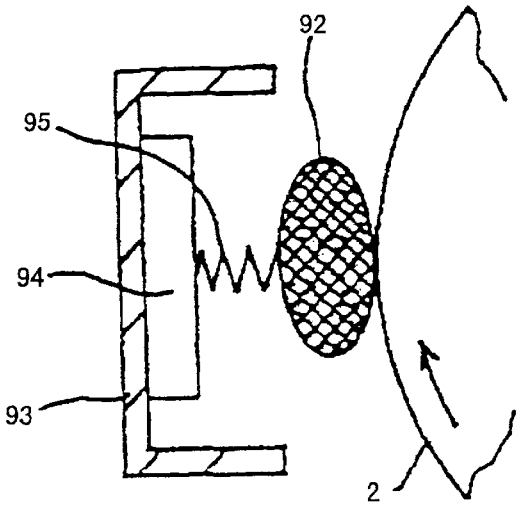
FIGS. 17 to 20 are schematic views illustrating other embodiments of the lubricant supplying device of the image forming apparatus of the present invention.

In FIG. 17, a bag 92 having a porous lubricant therein directly contacts the surface of a photoconductor 2. The bag extends in a direction parallel to the longitudinal direction of the photoconductor 2. The bag 92 is pressed so as to contact the photoconductor 2 by an elastic member 95, such as a spring, which is supported by a supporter 94 disposed on a case 93. By controlling the pressure of the elastic member 95, the quantity of the lubricant to be supplied to the photoconductor 2 can be controlled.

Figure 18:
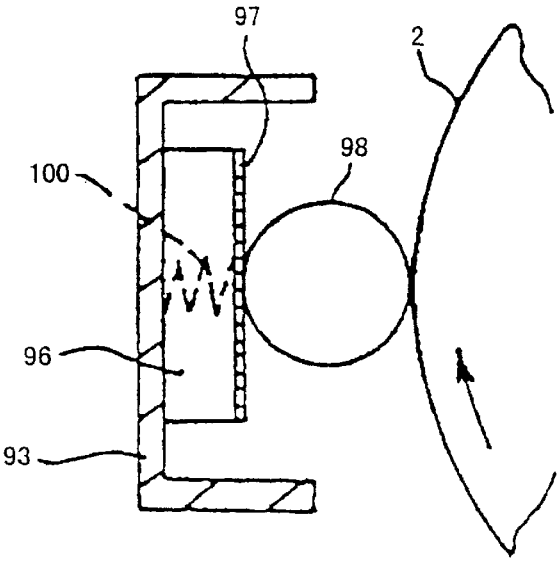
Figure 19:
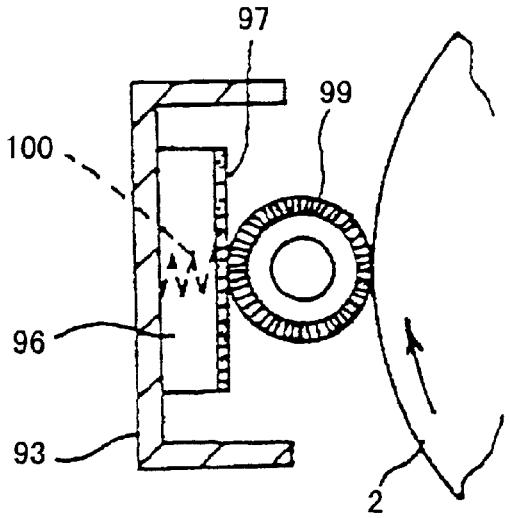

FIGS. 18 and 19 illustrate an indirect type lubricant supplying device. A porous lubricant 97 is supported by a supporter 96 provided on a case 93. A lubricant supplying roller 98, which extends in a direction parallel to the longitudinal direction of the photoconductor 2, contacts the lubricant 97 and a part of the lubricant 97, which transfers on the lubricant supplying roll, is re-transferred to the photoconductor 2. The lubricant supplying roller 98 can be replaced with a lubricant supplying brush 99 as shown in FIG. 19. The lubricant 97 is pressed to the lubricant supplying roller 98 or the lubricant supplying brush 99 by an elastic member 100. By changing the pressure, the amount of the lubricant 97 to be supplied can be controlled.

Figure 20:
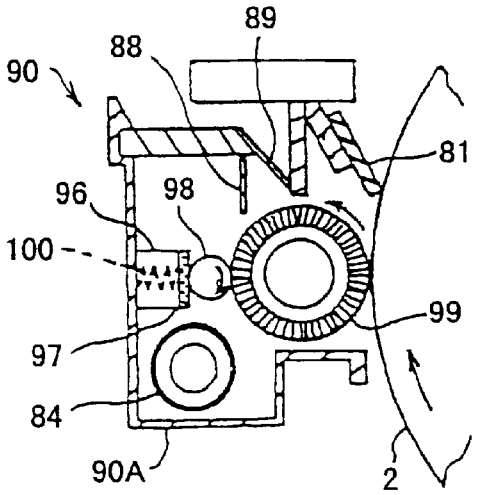

FIG. 20 illustrates a lubricant supplying device 90 in which both a lubricant supplying roller 98 and lubricant supplying brush 99 are used. The lubricant supplying device 90 includes a supporter 96 which is provided on a case 90A and which supports a lubricant 97, the lubricant supplying roller 98 which contacts the lubricant 97 to transfer a part of the lubricant 97, and the lubricant supplying brush 99 which contacts the lubricant supplying roller 98 and the surface of the photoconductor 2 to transfer the lubricant 97 to be supplied to the photoconductor 2. In addition, the lubricant supplying device 90 includes a cleaning blade 81 which scrapes a residual toner, a seal 89 which seals an entrance of the lubricant supplying device 90 to prevent toner scattering, a toner collecting roller 84 which collects the scraped toner, and a flicker 88 which regulates collected toner. The lubricant 97 is pressed by an elastic member 100.

Since the rotating direction of the lubricant supplying brush 99 is set so as to be opposite to the rotating direction of the lubricant supplying roller 98, the lubricant 97 to be transferred to the lubricant supplying brush 99 is uniformly applied on the lubricant supplying brush 99 along the longitudinal direction thereof. Similarly, the rotating direction of the lubricant supplying brush 99 is also set so as to be opposite to the rotating direction of the photoconductor 2, the lubricant 97 to be transferred to the photoconductor 2 is uniformly applied on the photoconductor 2 along the longitudinal direction thereof.

By using the lubricant supplying devices having at least one of the lubricant supplying roller 98 and lubricant supplying brush 99 as shown in FIGS. 18–20, the pressure of contact of the lubricant supplying roller 98 or the lubricant supplying brush 99 with the lubricant can be reduced compared to the direct applying method, and therefore a small amount of the lubricant can be uniformly applied on the surface of the photoconductor 2. In addition, by using the lubricant supplying device as shown in FIG. 17, a small amount of the lubricant can be applied on the surface of the photoconductor 2 because the lubricant is applied on the surface of the photoconductor 2 through the textile of the bag 92.

Next, a sixth embodiment of the image forming apparatus of the present invention will be explained.

Figure 21:
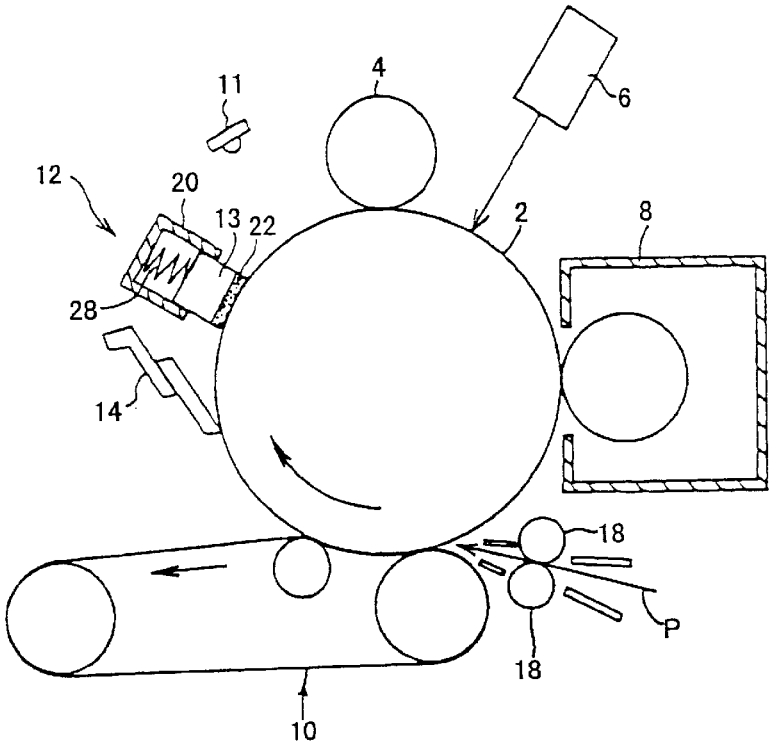
FIG. 21 is a schematic side view illustrating a primary part of a still further embodiment of the image forming apparatus of the present invention.

FIG. 21 is a schematic view illustrating a primary part of the sixth embodiment of the image forming apparatus. The image forming apparatus shown in FIG. 21 is the same as that shown in FIG. 10 except that the place of the lubricant supplying device 12 is changed. Therefore only the lubricant supplying device 12 will be hereinafter explained.

As shown in FIG. 21, a lubricant supplying device 12 is provided at a location downstream from the cleaning blade 14. The lubricant supplying device 12 includes a case 20 which is fixed to a main body of the apparatus (not shown), a block stay 13 which can move through the case 20, a lubricant 22 which is fixed to one end of the stay 13 and which directly contacts a photoconductor 2 serving as an image carrier, and a spring 28 which connects the case 20 and the stay 13. The lubricant 22 is pressed with the pressure of the spring 28 so as to contact the surface of the photoconductor 2 at a predetermined pressure.

Suitable materials for use as the lubricant 22 include known lubricating materials. Among these lubricating materials, PTFE, PTFE including low molecular weight PTFE, and PTFE including a filler, and compression moldings and porous materials of these materials are preferably used because of having good ability to be supplied to the image carrier and good transferability.

Hereinafter a case will be explained in which PTFE is used as the lubricant 22. The properties of PTFE are suitable for the constitution of the lubricant supplying device 12 of the sixth embodiment, and PTFE can exert good lubricating properties even when applied on the photoconductor 2 in a small amount. Various PTFE products such as powders, sheets, tapes and films are on sale. These products can be used by being subjected to treatment such as cutting and polishing as well as the moldings and the like mentioned above.

The target value of the coefficient of static friction of the image carrier (photoconductor 2) is not greater than about 0.4, and preferably from about 0.3 to about 0.1, which is the same as those in the first to fifth embodiments of the present invention.

According to the running test performed by the present inventors, the amount of abrasion of the photoconductor 2 was reduced to about ¼ when using a lubricant supplying device 12 compared to a case without using the lubricant supplying device 12. The conditions of the running test are as follows:

(1) thickness of the lubricant: 2 mm
(2) the number of sheets used for the running test: 200,000 (A4 size)
(3) feeding direction of the sheets: a direction vertical to the longitudinal direction of the sheet The lubricant supplying device 12 of the sixth embodiment will be explained in detail with reference to FIGS. 22 and 23.

Figure 22:
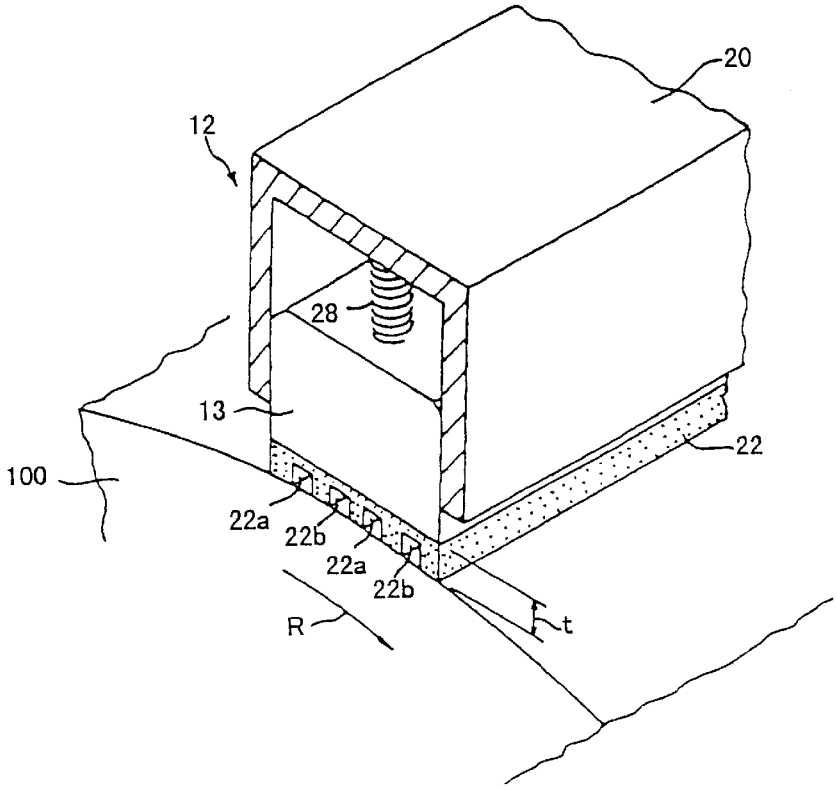
FIG. 22 is a schematic enlarged view illustrating a further embodiment of the lubricant supplying device of the image forming apparatus of the present invention.
Figure 23:
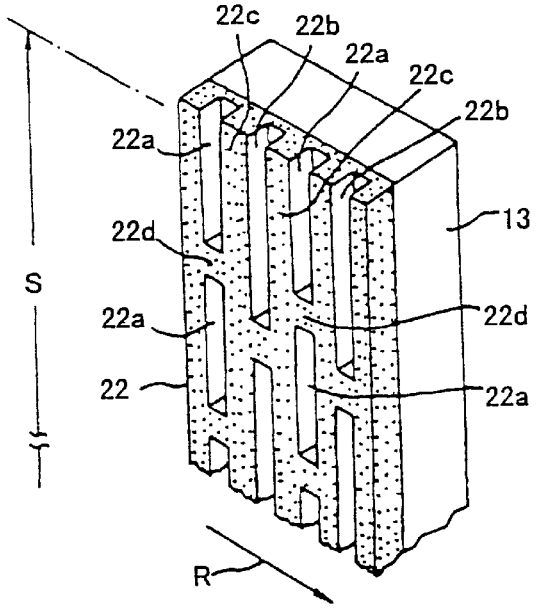
FIG. 23 is a perspective view illustrating an embodiment of the lubricant from the bottom side thereof, which is for use in the lubricant supplying device of the image forming apparatus of the present invention.

As shown in FIGS. 22 and 23, the lubricant 22 has convexes and concaves on the side of the lubricant 22. The convexes contact the photoconductor 2. The convexes are formed by a plurality of grooves (i.e., concaves) 22*a* and 22*b* which have a shape of rectangular prism and which are formed vertically to the rotating direction R of the photoconductor 2. The grooves 22*a* and 22*b* are separated by a convex 22*c*. Each of the grooves 22*a* and 22*b* is also separated by a convex 22*d*. The grooves 22*a* and 22*b* are alternately formed on the surface of the lubricant 22 so that the longitudinal ends of the grooves 22*a* and 22*b* are not on a straight line parallel to the rotating direction R of the photoconductor 2. Namely the convexes 22*d* of the photoconductor 2 are formed like steps in the rotating direction R of the photoconductor 2.

Figure 24:
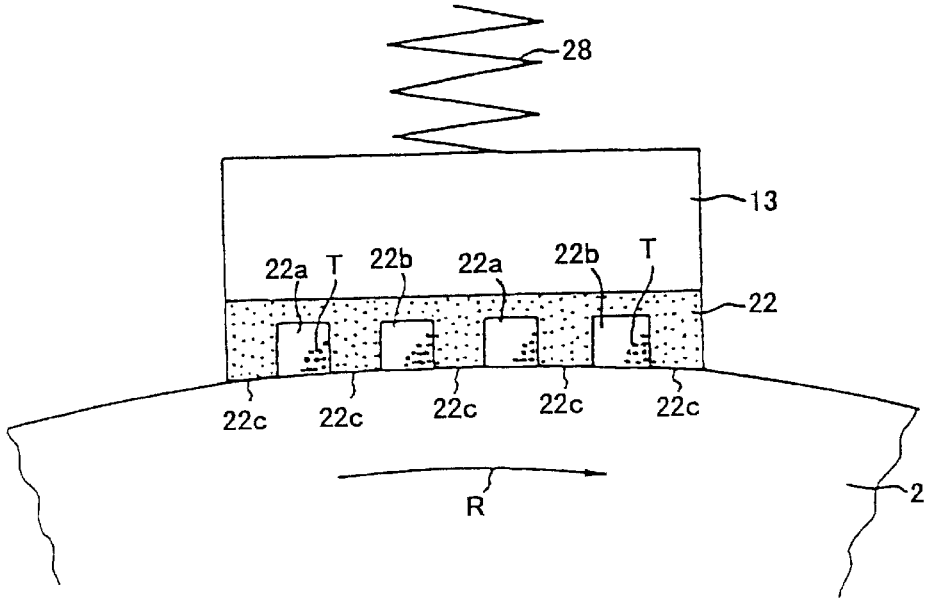
FIG. 24 is a schematic view illustrating a toner scraping operation by a lubricant having a recess for use in the lubricant supplying device of the image forming apparatus of the present invention.

By forming the grooves 22*a* and 22*b* on the surface of the lubricant 22, the contacting area of the lubricant 22 with the photoconductor 2 decreases, and thereby the lubricant 22 can be applied in a proper amount to the surface of the photoconductor 2, resulting in reduction of abrasion of the photoconductor 2 without generating any problems such as decrease of image density of character images, which is caused by thick film formation of the lubricant 22 on the surface of the photoconductor 2. Even when a part of the lubricant 22 is released therefrom and therefore an excess amount of the lubricant 22 is applied to the photoconductor 2, the released part, i.e., the excess lubricant, can be contained in the grooves 22*a* and 22*b*. The lubricant thus contained in the grooves 22*a* and 22*b* is gradually re-applied to the photoconductor 2. In addition, a residual toner remaining on the surface of the photoconductor 2 is scraped with the edges of the grooves 22*a* and 22*b* and contained in the grooves 22*a* and 22*b*, as shown in FIG. 24. Thus, a problem in that toner forms a film on the surface of the photoconductor 2 can be avoided. Character T denotes the toner scraped by the grooves 22*a* and 22*b*.

Thus, the lubricant 22 is always applied uniformly to the surface of the photoconductor 2, resulting in decrease of the friction coefficient of surface of the photoconductor 2, and thereby the abrasion of the photoconductor 2 can be decreased.

In addition, the lubricant supplying device 12 is disposed on the photoconductor 2 downstream from the cleaning blade 14 with respect to the rotating direction of the photoconductor 2, the ability of preventing toner film formation can be further enhanced because a residual toner which is considerably scraped by the cleaning blade 14 is further scraped by the grooves 22*a* and 22*b* of the lubricant 22 of the lubricant supplying device 12.

If the grooves 22*a* and 22*b* are formed without the convexes 22*d*, the lubricant contained in the grooves 22*a* and 22*b* tends to move to a point of each groove, which is caused by the rotation of the photoconductor 2, resulting in uneven application of the lubricant 22. Therefore it is preferable to separate the grooves 22*a* and 22*b* by the convexes 22*d*. In addition, by forming the convexes 22*c* and 22*d*, the mechanical strength of the lubricant 22 can be enhanced. The width of each of the convexes 22*c* and 22*d* and grooves 22*a* and 22*b* in the rotating direction of the photoconductor 2 is preferably uniform. The number of the convexes 22*c* and 22*d* and grooves 22*a* and 22*b* is preferably large to exert the above-mentioned good performance of the lubricant supplying device 12. The length of each of the grooves 22*a* and 22*b* in the longitudinal direction is the same as or different from each other.

Figure 25:
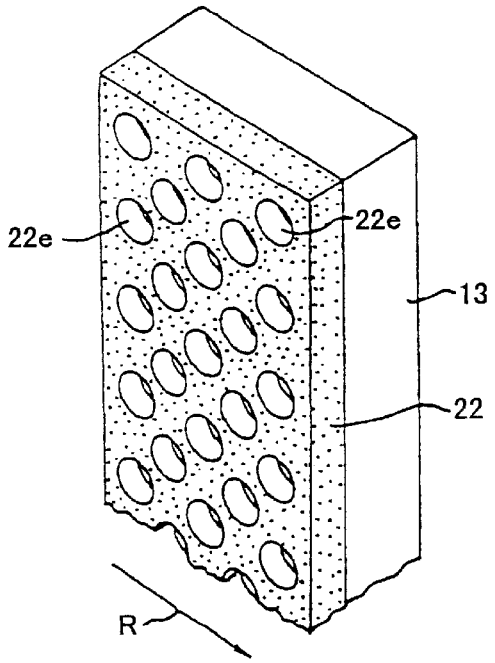
FIG. 25 is a perspective view illustrating another embodiment of the lubricant from the bottom side thereof, which is for use in the lubricant supplying device of the image forming apparatus of the present invention.

Alternatively, the lubricant 22 may have a form as shown in FIG. 25 in which a plurality of cylindrical concaves 22*e* are formed. It is preferable to arrange the cylindrical concaves 22*e* like a checkered pattern to avoid the toner filming problem and to gradually release the lubricant 22. In FIG. 25, an arrow R denotes the rotating direction of an image carrier with which the lubricant 22 contacts.

Figure 26:
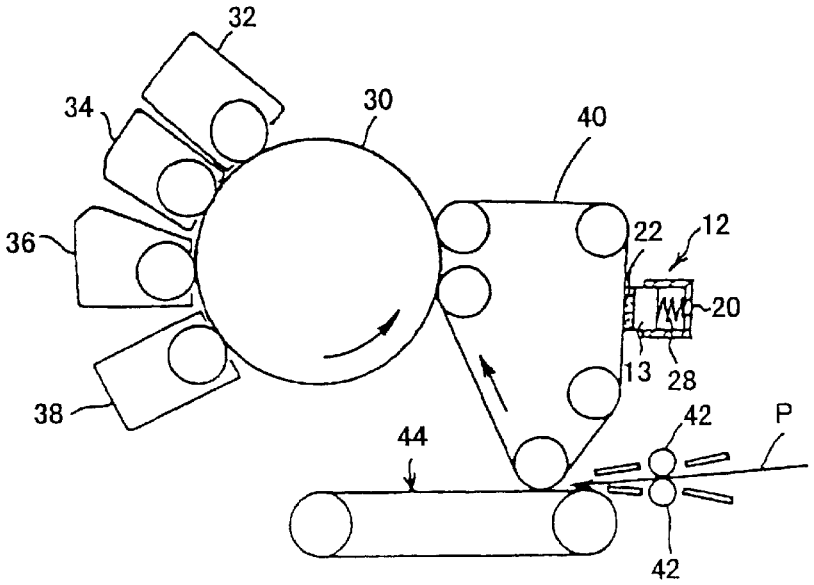
FIG. 26 is a schematic side view illustrating a primary part of a still further embodiment of the image forming apparatus of the present invention, which includes an intermediate transfer belt as an image carrier.

In addition, as shown in FIG. 26, the image carrier to which the lubricant 22 is to be applied may be an intermediate transfer belt 40 instead of the photoconductor 2. The constitution of the image forming apparatus shown in FIG. 26 is almost the same as that shown in FIG. 3 except that a lubricant supplying device 12 directly supplies the lubricant to the intermediate transfer belt 40. A cleaning blade (not shown) is provided so as to scrape a residual toner remaining on the surface of the intermediate transfer belt 40. The lubricant supplying device 12 may be disposed on the intermediate transfer belt 40 downstream or upstream from the cleaning blade with respect to the rotating direction of the intermediate transfer belt 40.

Figure 27:
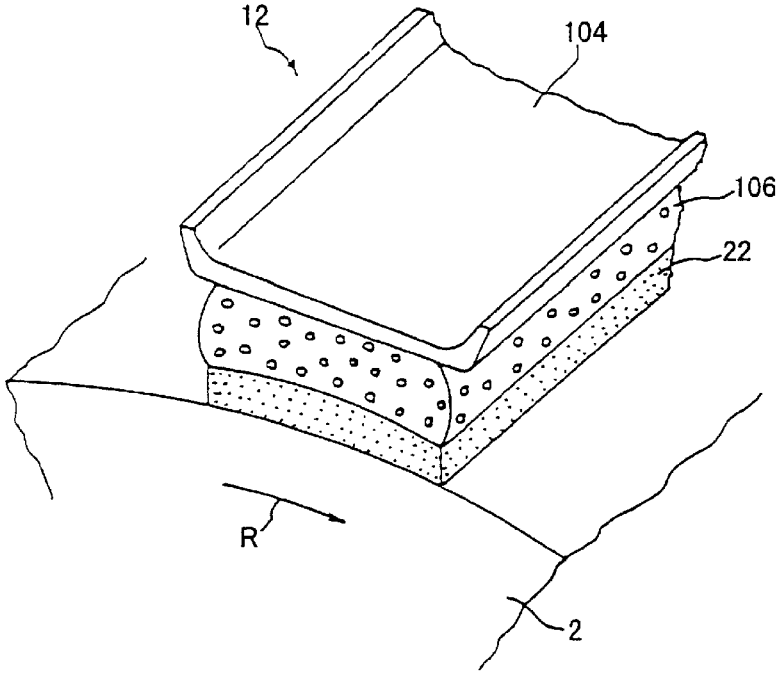
FIG. 27 is a perspective view illustrating a still further embodiment of the lubricant supplying device of the image forming apparatus of the present invention.

FIG. 27 is a schematic view of another lubricant supplying device 12 of the sixth embodiment of the image forming apparatus of the present invention.

In FIG. 27, the lubricant supplying device 12 includes a supporting plate 104 which is fixed to the main body of the apparatus, an elastic member 106 whose one side is fixed to the supporting plate 104, and a lubricant 22 which is fixed to the other side of the elastic member. The lubricant 22 is appropriately pressed to the photoconductor 2, which rotates in a direction shown by an arrow R, by the pressure of the elastic force of the elastic member 106. The lubricant 22 may be the lubricant 22 having cylindrical concaves 22*e* as shown in FIG. 25 or the lubricant 22 having grooves as shown in FIG. 23.

Next, the method to control an supplying amount of the lubricant 22 will be explained with reference to FIGS. 28–30.

In general, abrasion of a lubricant is performed by the shear force generated by the contact of the lubricant and an image carrier, and some molecules of the lubricant are scraped and transferred to the image carrier, resulting in decrease of friction coefficient of the surface of the image carrier. As shown in FIG. 28, the amount of the abraded lubricant, i.e., the amount of the lubricant supplied to an image carrier, rapidly increases when a product PV of a slipping velocity V and a load P which is applied to a unit area of the contact area of the lubricant 22 with the image carrier exceeds a specified value. At this point, the slipping velocity V which is the linear velocity of the image carrier is determined depending on other factors such as copying speed of the apparatus. Therefore the amount of abrasion of the lubricant depends on only the load P if the slipping velocity is fixed at a predetermined value.

When an image carrier has a relatively high friction coefficient $\mu$, i.e., an image carrier is in an initial state, it is desired to increase the amount of the lubricant 22 to be supplied in order to rapidly decrease $\mu$ of the image carrier. When the image carrier achieves a relatively low friction coefficient $\mu$, the amount of abrasion of the lubricant 22 should be decreased.

Figure 29:
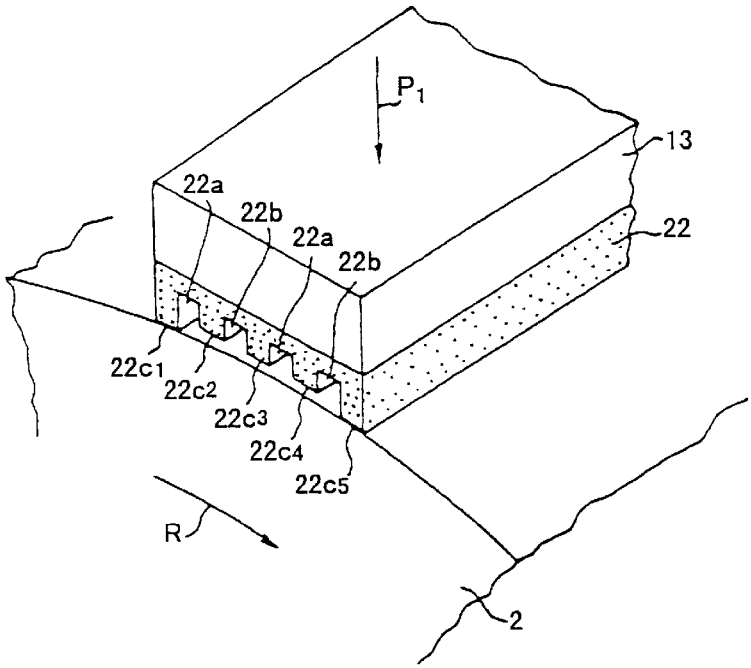
FIG. 29 is a perspective view illustrating yet another embodiment of the lubricant for use in the lubricant supplying device of the image forming apparatus of the present invention, in which an amount of the abrasion of the lubricant can be controlled.
Figure 30:
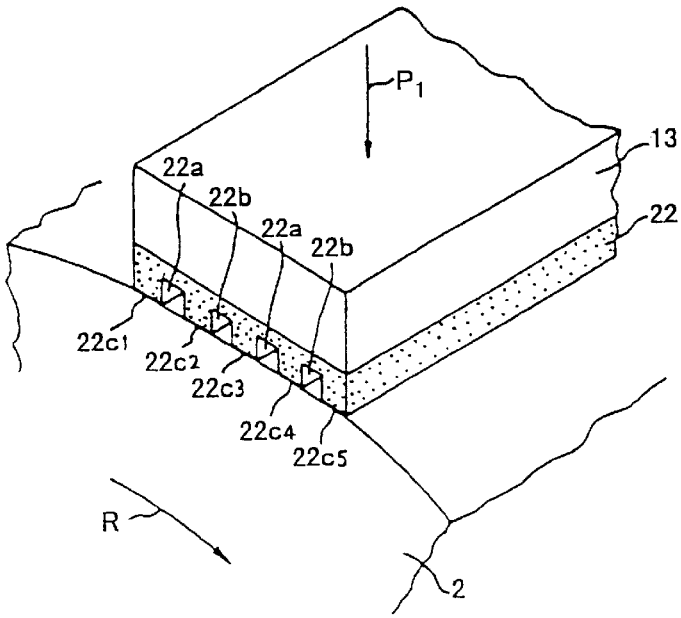
FIG. 30 is a perspective view illustrating a used state of the lubricant shown in FIG. 29.

From this point of view, the lubricant 22 as shown in FIG. 29 is preferable. In FIG. 29, the lubricant 22 has also grooves 22*a* and 22*b* which is shaped like a rectangular prism. However, the lubricant 22 has convexes 22*c*1 and 22*c*5 which are the front end and the rear end of the convexes in the rotating direction of the photoconductor 2 and which are higher than the other convexex 22*c*2, 22*c*3 and 22*c*4. When the lubricant 22 initially contacts the photoconductor 2, only the convexes 22*c*1 and 22*c*5 contact the photoconductor 2. Character P1 denotes a pressuring force of a spring (not shown).

Figure 28:
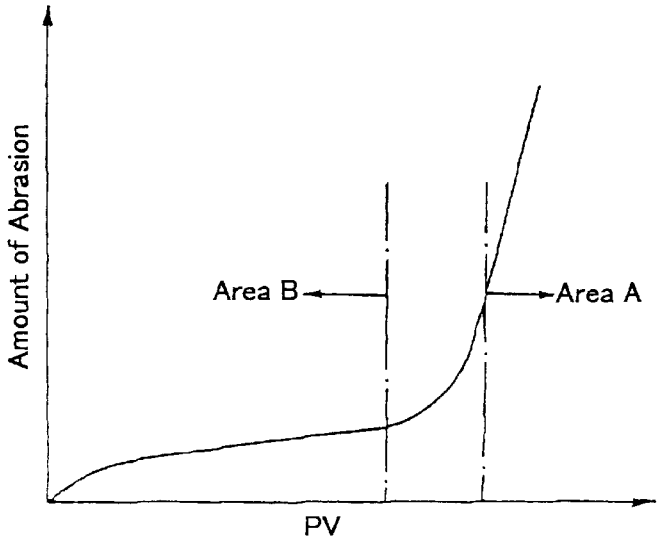
FIG. 28 is a graph illustrating a relationship between an amount of abrasion of a lubricant and a product of a load P applied to the lubricant and a slipping velocity V of the lubricant.

At this initial contacting state, since the contact area of the lubricant 22 and with the photoconductor 2 is small and therefore the load (pressure) P is large, the product PV is in a point in the area A in FIG. 28 in which the lubricant 22 is rapidly abraded, and therefore lubricant 22 is rapidly applied to the surface of the photoconductor 2. When the convexes 22*c*1 and 22*c*5 are abraded so as to have the same height as the other convexes 22*c*2, 22*c*3 and 22*c*4 as shown in FIG. 30, the contact area of the lubricant 22 with the photoconductor 2 increases, and thereby the product PV decreases to a point in the area B in which the lubricant 22 is gradually abraded.

Thus, by controlling the shape and the contact pressure of the lubricant 22, the amount of abrasion of the lubricant 22, i.e., the amount of the lubricant to be applied to an image carrier, can be controlled so as to be large in an initial state and become small with elapse of time.

In contrast, when it is desired to increase the amount of abrasion of the lubricant 22, the contact pressure should be controlled so as to increase with elapse of time, or the contact area should be controlled so as to reduce with elapse of time.

Thus, the amount of the lubricant 22 to be applied to an image carrier can be freely controlled.

In addition, by including a filler in the lubricant 22, the amount of abrasion of the lubricant 22 widely changes, and therefore a lubricant suitable for the purpose of the lubricant supplying device can be designed.

Next, a seventh embodiment of the image forming apparatus of the present invention will be explained.

Figure 31:
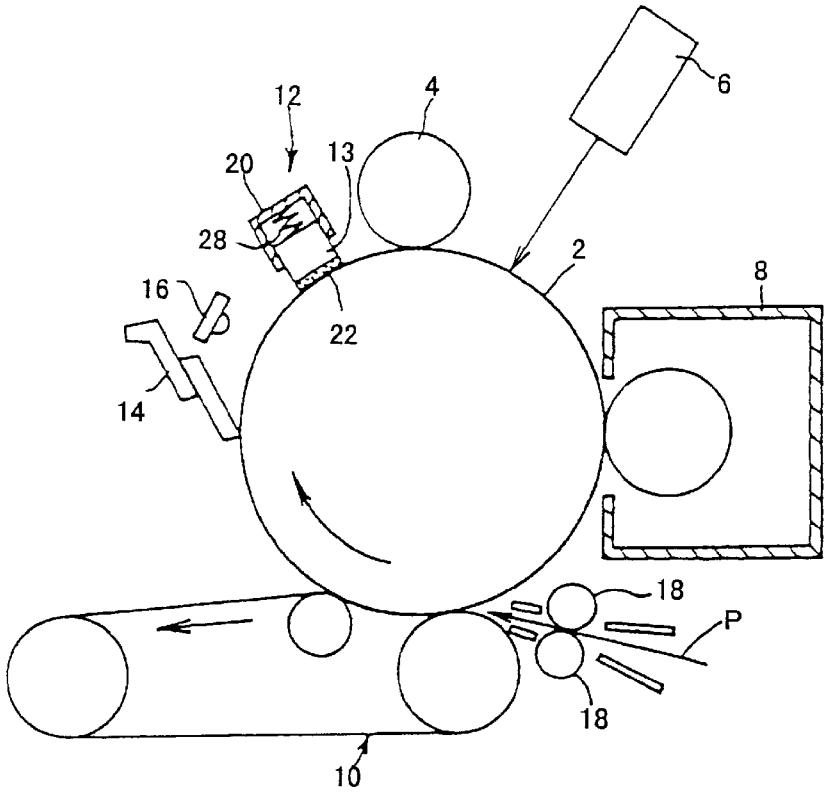
FIG. 31 is a perspective view illustrating the primary part of a still further embodiment of the image forming apparatus of the present invention.

FIG. 31 is a schematic view illustrating a primary part of a seventh embodiment of the image forming apparatus of the present invention. The apparatus shown in FIG. 31 is almost the same as that shown in FIG. 21 except that the lubricant supplying device 12 is disposed downstream from the discharger 16 with respect to the rotating direction of the photoconductor 2. Therefore only the lubricant supplying device 12 will hereinafter explained.

In FIG. 31, the lubricant supplying device 12 includes a case 20 which is fixed to a main body (not shown) of the apparatus, a stay 13 which has a shape of rectangular prism and which is movably contained in the case 20, a lubricant 22 which is fixed on one side of the stay 13, which side faces the photoconductor 2, and a spring 28 which presses the stay 13 toward the photoconductor 2.

The target value of the coefficient of static friction of the image carrier (photoconductor 2), which is measured by the Euler belt method, is also not greater than about 0.4 and preferably from about 0.3 to about 0.1, which is the same as in the cases of the first to sixth embodiment of the present invention.

The lubricant 22 includes at least PTFE which is molded by a compression molding method including a sintering process. The lubricant 22 may be PTFE including low molecular weight PTFE or PTFE including a filler, as mentioned for use in the first to six embodiment.

The compression molding method broadly classified into a free baking method and a hot molding method. The difference between these methods is the difference in sintering process. The lubricant 22 for use in the seventh embodiment can be prepared by both the methods.

As mentioned above, PTFE cannot be molded by an ordinary molding method which can be used for general resins, and typically molded by a compression molding method.

Compression molding methods, which can be preferably used for molding of PTFE, will be hereinafter explained. The procedures in a compression molding method (free baking method) are as follows:

(1) a molding powder of PTFE is evenly contained in a mold having a desired shape;

(2) the powder is pressed at room temperature to form a preliminary molding (referred to as a preform), which is still brittle;

(3) the preform is then contained in an oven and heated to a sintering temperature and allowed to settle at a predetermined temperature; and (4) the sintered preform is cooled at a constant speed to obtain a molding.

When the molding is desired to have an accurate dimension, the molding is preferably subjected to secondary treatment such as cutting (for example, skive processing) and the like.

The procedure for preparation of the lubricant 22 in the seventh embodiment will be hereinafter explained.

Figure 32:
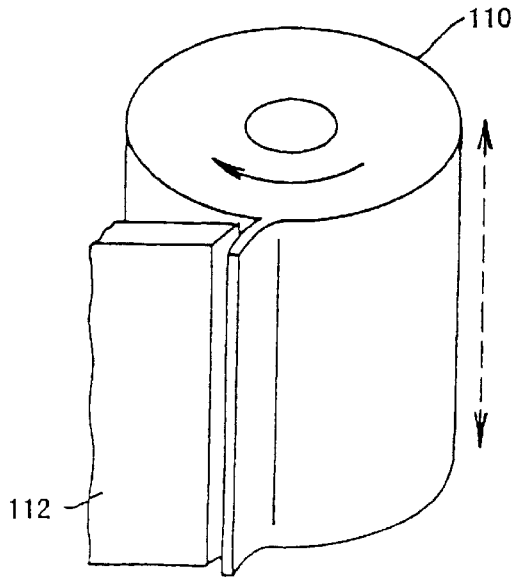
FIG. 32 is a schematic view illustrating an operation of forming a lubricant for use in the lubricant supplying device of the image forming apparatus of the present invention.

The sheet lubricant can be prepared by cut processing, as shown in FIG. 32.

Figure 33:
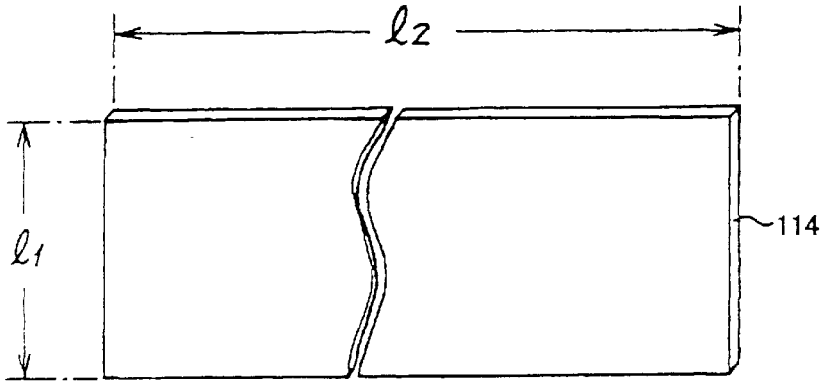
FIG. 33 is a schematic view illustrating a sheet-shaped lubricant for use in the lubricant supplying device of the image forming apparatus of the present invention, which is made by cutting a block-shaped lubricant.

A sintered block 110 is molded so as to have a column or a cylinder shape because the following cut processing can be easily performed. The block 110 is typically compressed in its longitudinal direction shown by a broken-line arrow in FIG. 32. A sheet lubricant is prepared by cutting the block 110 with a cutter 112 while the block is rotated in a direction shown by a solid-line arrow. Thus a sheet lubricant 114 which is as shown in FIG. 33 can be prepared. The length $l_1$ is generally shorter than the length $l_2$ because the length $l_1$ depends on the size of the mold used.

Figure 34:
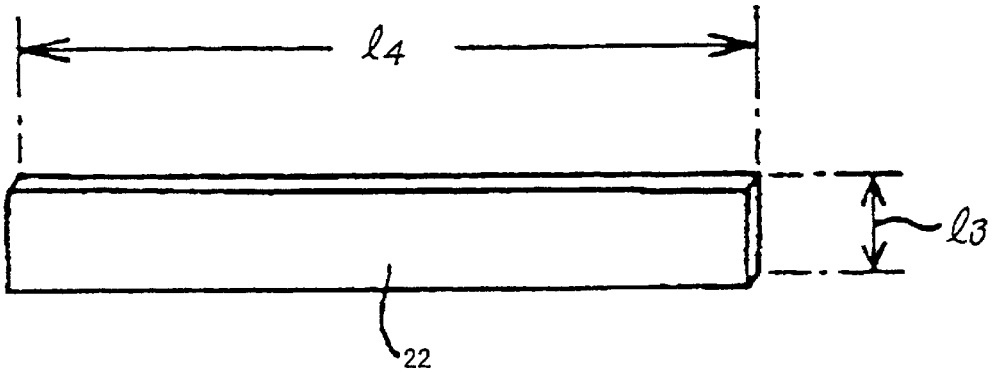
FIG. 34 is a schematic view illustrating an embodiment of the sheet-shaped lubricant, which is prepared by the lubricant shown in FIG. 33 and which is for use in the lubricant supplying device of the image forming apparatus of the present invention.
Figures 35A, 35B:
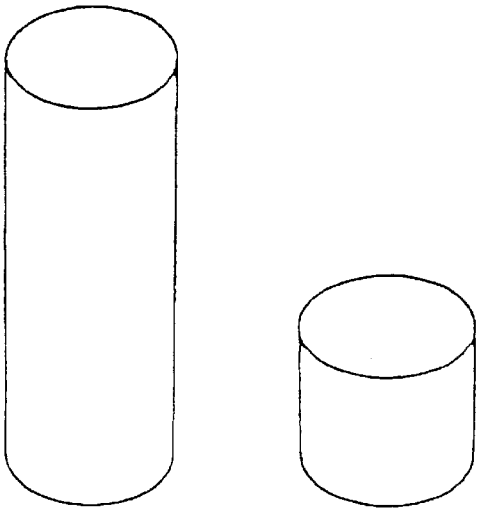
FIGS. 35A and 35B are schematic views illustrating compression molded lubricants which are made by metal molds having different sizes.
Figure 37:
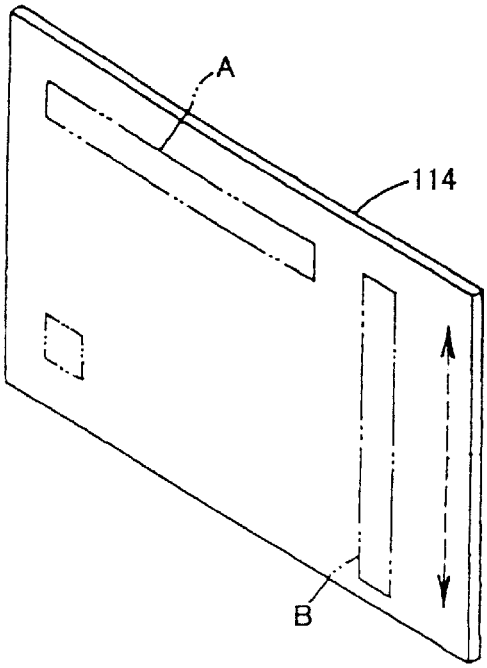
FIG. 37 is a schematic perspective view illustrating another sheet-shaped lubricant for use in the lubricant supplying mechanism of the image forming apparatus of the present invention, which is made by cutting a block-shaped lubricant.

A suitable lubricant for use in the seventh embodiment includes a sheet lubricant 22 shown in FIG. 34. When the sheet lubricant 22 is obtained by cutting the sheet lubricant 114, the sheet lubricant 114 is preferably cut so that the longitudinal direction of the resultant sheet lubricant 22 is substantially parallel to the longitudinal direction of the sheet lubricant 114, i.e., like A as shown in FIG. 37, because a sheet lubricant 22 having a relatively long size can be prepared even when using a small size mold as shown in FIG. 35B instead of a large size mold as shown in FIG. 35A. Large size molds are expensive, and in addition even when a large size mold is used, it is hard to handle the resultant molding, and therefore the manufacturing costs increase.

The image carrier is not limited to the photoconductor 2 and the intermediate transfer belt 40 as shown in FIG. 26 can also be employed. At this point, the lubricant supplying device 12 is preferably disposed at a location downstream from a cleaning blade.

Figure 36:
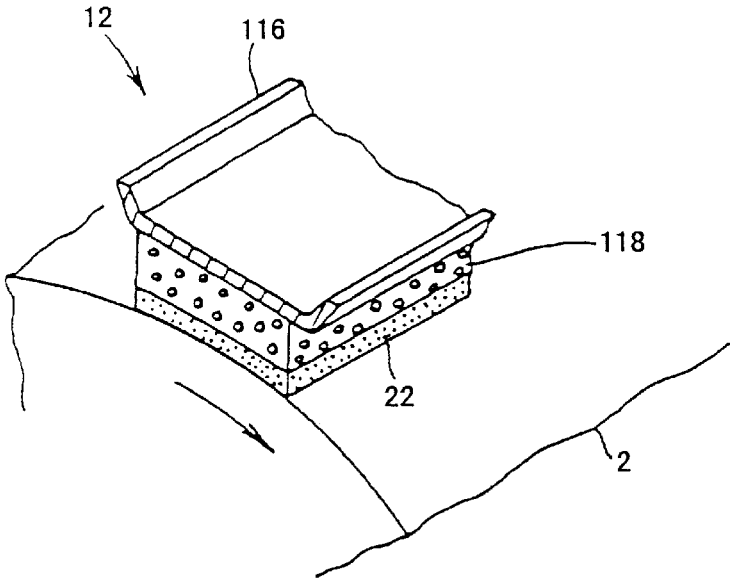
FIG. 36 is a schematic perspective view illustrating a primary part of a still further embodiment of the lubricant supplying device of the image forming apparatus of the present invention, which directly supplies a lubricant to an image carrier.

Another lubricant supplying device 12 for use in the seventh embodiment is shown in FIG. 36. The lubricant supplying device 12 includes a supporting plate 116 which is fixed to a main body (not shown) of the apparatus, an elastic material 118, and a lubricant 22, wherein the lubricant 22 is elastically pressed to the photoconductor 2 by the elastic material 118.

In the seventh embodiment, the lubricant supplying device 12 is not limited to the method in which the lubricant 22 is directly applied to the photoconductor 2, and indirect supplying method can be employed as shown in FIGS. 1 or 3.

Next, an eighth embodiment of the image forming apparatus will be explained referring to figures.

The image forming apparatus has constitution as shown in FIG. 31. In addition, the lubricant 22 includes materials including PTFE as mentioned above for use in the lubricant 22 in the seventh embodiment. The constitutional feature of the eighth embodiment of the image forming apparatus is the configuration of the lubricant 22 against the image carrier. The feature will be explained with reference to FIGS. 31 and 32.

Figure 38A:
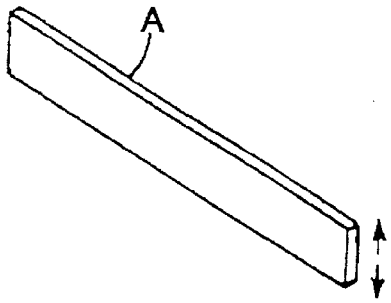
FIGS. 38A and 38B are schematic views illustrating lubricant sheets made by cutting the sheet-shaped lubricant shown in FIG. 37.
Figure 38B:
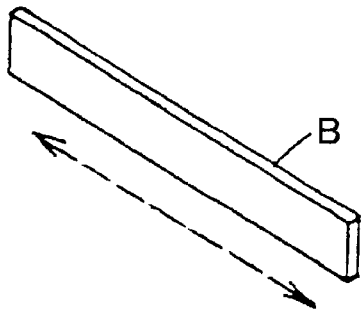
Figure 39A:
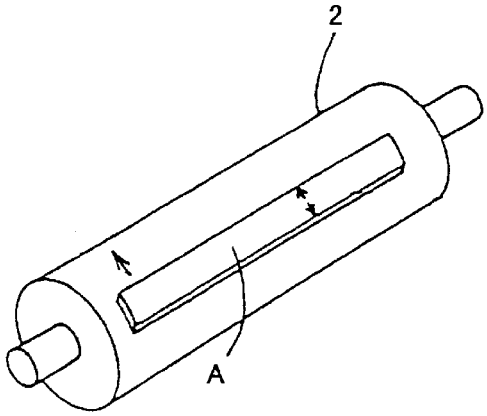
FIGS. 39A and 39B are schematic perspective views illustrating the lubricant sheets shown in FIGS. 38A and 38B, each contacting an image carrier.
Figure 39B:
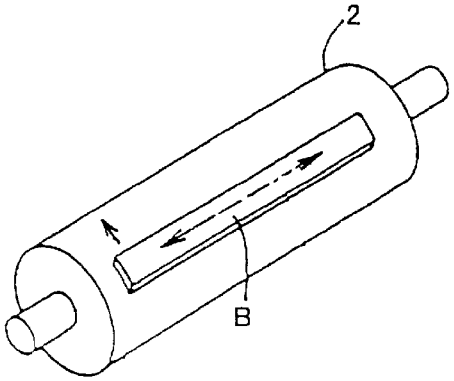
Figure 40:
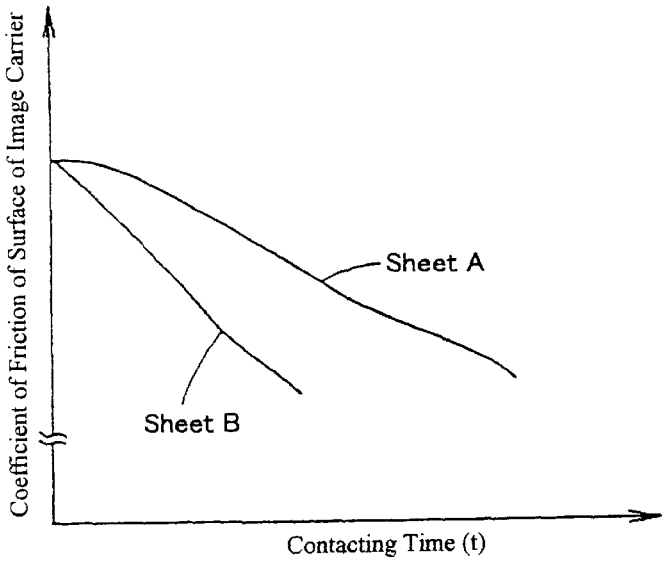
FIG. 40 is a graph illustrating changes of coefficient of friction of an image carrier with elapse of time when the image carrier rotates while contacting lubricant sheets shown in FIGS. 38A and 38B.

A sheet lubricant 22 is prepared by cutting a sintered block 110, which has a columnar shape or a cylindrical shape and which is rotated in a direction of a solid-line arrow, with a cutter 112 as shown FIG. 32. The compression direction is generally the direction shown by a broken-line arrow in FIG. 32. Thus, a sheet lubricant 114 as shown in FIG. 37 can be prepared. There are two methods for preparing a small sheet lubricant. Namely, one of the methods is to prepare a small sheet lubricant A in which the longitudinal direction of the small sheet lubricant A is substantially vertical to the compression direction, and the other is to prepare a small sheet lubricant B in which the longitudinal direction of the small sheet lubricant B is substantially parallel to the compression direction. FIGS. 38A and 38B illustrate cut sheets A and B. In FIGS. 38A and 38B, the compression direction is shown by broken-line arrows. When each of these sheets A and B contacts with the respective photoconductor 2 while the photoconductor 2 is rotating as shown in FIGS. 39A and 39B, the change of the friction coefficient of each photoconductor 2 is shown in FIG. 40. In FIGS. 39A and 39B, the broken-line arrows denote a compression direction and a solid-line arrows denote a moving direction of the photoconductor 2. As can be understood from FIG. 40, the sheets A and B have a different lubricant transfer speed. Namely, the abrasion ability (an ability to be supplied) of the sheet lubricants which are prepared by a compression molding method depends on the direction of contact of the lubricant with the photoconductor 2.

Figure 41:
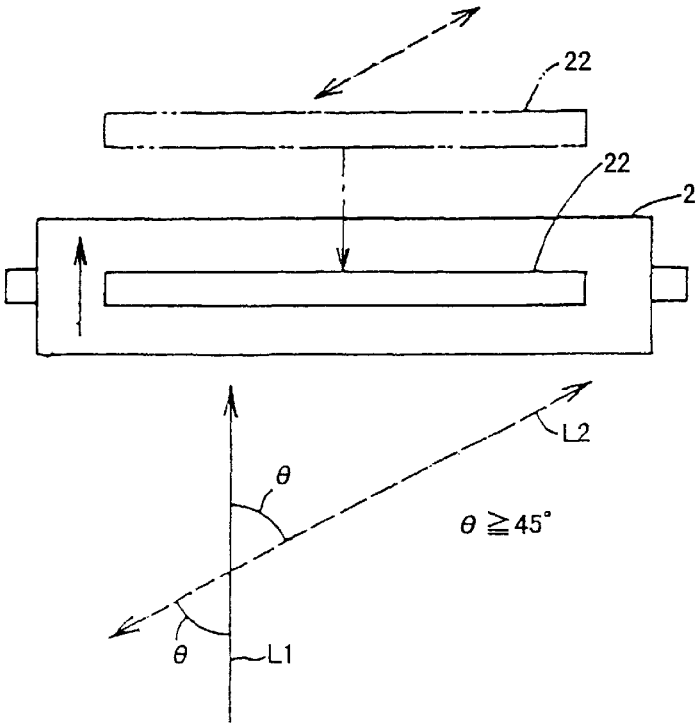
FIG. 41 is a schematic view illustrating a preferable state of contact of a sheet lubricant with an image carrier in the present invention.

As a result of the detailed examination, the ability of the sheet lubricant 22 to be supplied is superior when a sheet lubricant 22 contacts the photoconductor 2 such that an acute angle θ formed by the moving direction L1 of the image carrier and the compression direction L2 of the sheet lubricant 22, as shown in FIG. 41, is from about 45° to about 90°.

Figure 42A:
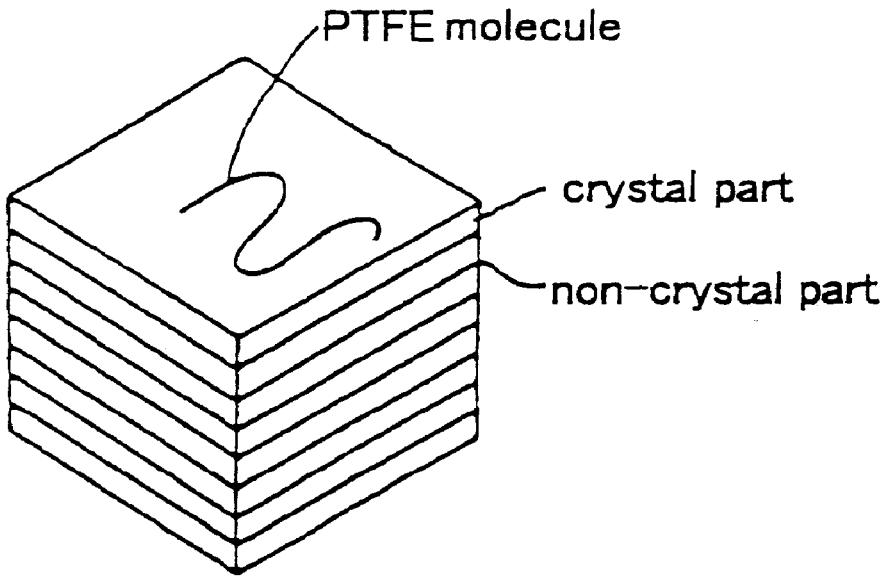
FIGS. 42A and 42B are schematic views illustrating crystal structure of a PTFE lubricant and slipping of the lubricant.
Figure 42B:
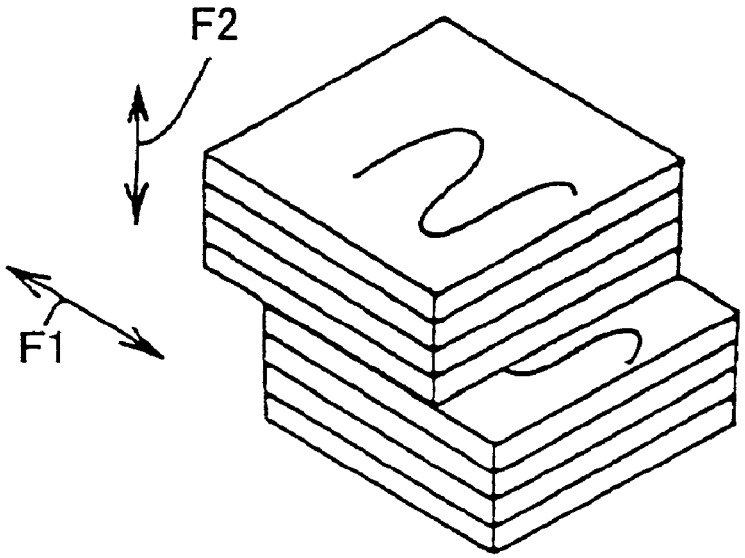

This is considered to be caused by the orientation of the PTFE crystals. If the crystals of PTFE orient as shown in FIG. 42A, PTFE slips at a non-crystal part as shown in FIG. 42B when a force F1 is applied,. Therefore PTFE can easily peeled and supplied to the image carrier. If a force F2 is applied, PTFE tends not to slip compared to the case in which F1 is applied. Such a phenomenon frequently occurs in a thin sheet.

The ability to be supplied is maximized when the acute angle θ formed by the line L1 which is the moving direction of the image carrier and the line L2 which is the compression direction of the lubricant 22 is about 90°.

Thus, by contacting the lubricant 22 with the image carrier such that the acute angle θ is from about 45° to about 90°, the supplying ability of the lubricant 22 can be enhanced, resulting in rapid decrease of the friction coefficient of the surface of the image carrier. Therefore the abrasion of the image carrier can be decreased. The image carrier is not limited to the photoconductor 2, and the intermediate transfer belt 40 which is used for a full color image forming apparatus as shown in FIG. 26 can also be used.

In the embodiment, the lubricant 22 directly contacts the image carrier, however, the lubricant 22 can be used for the indirect lubricant supplying devices as shown in FIGS. 1 and 2. Even in these case, it is preferable that the lubricant 22 is disposed so that an acute angle θ formed by the line of the moving direction of the lubricant supplying roller 24 (or the lubricant supplying brush 26) and the line of the compression direction of the lubricant 22 is from about 45° to about 90°, and it is more preferable that the lubricant 22 is disposed so that the acute angle θ is about 90°.

As mentioned above, by using the lubricant and the lubricant supplying device of the present invention, the coefficient of friction of an image carrier rapidly decreases and thereby the abrasion of the image carrier can be decreased and a toner filming problem is avoided, resulting in prevention of the image carrier from deteriorating. The lubricant of the present invention can be easily prepared without complicated processes.

This document claims priority and contains subject matter related to Japanese Patent Applications No. 10-107553, 10-121300, 10-201052, 10-201053, 10-202054, 10-146753, 10-118070 and 10-206093, filed on Apr. 17, 1998, Apr. 30, 1998, Jul. 16, 1998, Jul. 16, 1998, Jul. 16, 1998, May 28, 1998, Apr. 28, 1998 and Jul. 22, 1998, respectively, incorporated therein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image carrier configured to carry an image while rotating; and a lubricant supplying device configured to supply a lubricant to the image carrier, wherein the lubricant comprises low molecular weight polytetrafluoroethylene.

2. The image forming apparatus according to claim 1, wherein the lubricant further comprises:

a fluorine-containing resin other than low molecular weight polytetrafluoroethylene.

3. The image forming apparatus according to claim 2, wherein the fluorine-containing resin other than low molecular weight polytetrafluoroethylene comprises:

a high molecular weight polytetrafluoroethylene.

4. The image forming apparatus according to claim 2, wherein the fluorine-containing resin other than low molecular weight polytetrafluoroethylene comprises:

a tetrafluoroethylene-perfluoroalkylvinyl ether copolymer.

5. The image forming apparatus according to claim 4, wherein the low molecular weight polytetrafluoroethylene comprises not greater than about 30% of the lubricant by weight.

6. The image forming apparatus according to claim 2, wherein the fluorine-containing resin other than low molecular weight polytetrafluoroethylene comprises:

a tetrafluoroethylene-hexafluoropropylene copolymer.

7. The image forming apparatus according to claim 6, wherein the low molecular weight polytetrafluoroethylene comprises not greater than about 30% of the lubricant by weight.

8. An image forming apparatus comprising:

an image carrier configured to carry an image while rotating; and a lubricant supplying device configured to supply a lubricant to the image carrier, wherein the lubricant comprises a fluorine-containing resin and a filler.

9. The image forming apparatus according to claim 8, wherein the fluorine-containing resin comprises:

polytetrafluoroethylene.

10. The image forming apparatus according to claim 8, wherein the filler comprises:

a material selected from the group consisting of particulate fillers, fibrous fillers, flaky fillers and platy fillers.

11. The image forming apparatus according to claim 8, wherein the filler comprises:

a self-lubricating material.

12. The image forming apparatus according to claim 8, wherein the filler is white or transparent.

13. An image forming apparatus comprising:

an image carrier configured to carry an image while rotating; and a lubricant supplying device configured to supply a lubricant to the image carrier, wherein the lubricant comprises heat decomposition treated polytetrafluoroethylene.

14. The image forming apparatus according to claim 13, wherein the lubricant is prepared by a molding process, and wherein the heat decomposition treatment is performed during the molding process.

15. The image forming apparatus according to claim 13, wherein the lubricant is prepared by a molding process, and wherein the heat decomposition treatment is performed after the molding process.

16. An image forming apparatus comprising:

an image carrier configured to carry an image while rotating; and a lubricant supplying device configured to supply a lubricant to the image carrier, wherein the lubricant comprises radiation decomposition treated polytetrafluoroethylene.

17. The image forming apparatus according to claim 16, wherein the lubricant is prepared by a molding process, and wherein the radiation decomposition treatment is performed during the molding process.

18. The image forming apparatus according to claim 16, wherein the lubricant is prepared by a molding process, and wherein the radiation decomposition treatment is performed after the molding process.

19. An image forming apparatus comprising:

an image carrier configured to carry an image while rotating; and a lubricant supplying device configured to supply a compression molded lubricant to the image carrier, wherein the lubricant comprises a fluorine-containing resin.

20. The image forming apparatus according to claim 19, wherein the fluorine-containing resin comprises:

polytetrafluoroethylene.

21. The image forming apparatus according to claim 19, wherein the fluorine-containing resin comprises:

a first polytetrafluoroethylene having a relatively high molecular weight; and a second polytetrafluoroethylene having a relatively low molecular weight relative to the first polytetrafluoroethylene.

22. The image forming apparatus according to claim 19, wherein the fluorine-containing resin comprises:

polytetrafluoroethylene; and a filler.

23. The image forming apparatus according to claim 19, wherein the image forming apparatus further comprises:

a cleaning device configured to clean a surface of the image carrier, wherein the lubricant supplying device is provided on a surface of the image carrier upstream from the cleaning device with respect to a rotating direction of the image carrier.

24. The image forming apparatus according to claim 19, wherein the lubricant supplying device further comprises:

a lubricant supplying member configured to supply the lubricant to the image carrier.

25. The image forming apparatus according to claim 24, wherein the lubricant supplying device further comprises:

a slip-contacting member configured to contact and slip against the image carrier when the image carrier rotates, wherein the slip-contacting member is provided on a surface of the image carrier downstream from the lubricant supplying member with respect to a rotating direction of the image carrier.

26. An image forming apparatus comprising:

an image carrier configured to carry an image while rotating; and a lubricant supplying device configured to supply a lubricant to the image carrier, wherein the lubricant comprises a porous fluorine-containing resin.

27. The image forming apparatus according to claim 26, wherein the porous fluorine-containing resin comprises:

a liquid lubricant.

28. The image forming apparatus according to claim 26, wherein the porous fluorine-containing resin comprises:

a solid lubricant.

29. The image forming apparatus according to claim 26, wherein the lubricant supplying device further comprises:

a lubricant supplying member configured to supply the lubricant to the image carrier.

30. The image forming apparatus according to claim 26, wherein the fluorine-containing resin comprises:

polytetrafluoroethylene.

31. The image forming apparatus according to claim 26, wherein the fluorine-containing resin comprises:

a first polytetrafluoroethylene having a relatively high molecular weight; and a second polytetrafluoroethylene having a relatively low molecular weight relative to the first polytetrafluoroethylene.

32. The image forming apparatus according to claim 26, wherein the fluorine-containing resin comprises:

polytetrafluoroethylene; and a filler.

33. An image forming apparatus comprising:

an image carrier configured to carry an image while rotating; and a lubricant supplying device configured to supply a lubricant to the image carrier, wherein the lubricant directly contacts the image carrier and a surface of the lubricant includes at least one concave portion facing the image carrier.

34. The image forming apparatus according to claim 33, wherein the surface of the lubricant comprises:

a plurality of concave portions serially arranged in the rotating direction of the image carrier, wherein the concave portions are separated from each other.

35. The image forming apparatus according to claim 33, wherein the length of the concave portion parallel to the axis of rotation of the image carrier is longer than the length of the image carrier along the axis of rotation.

36. The image forming apparatus according to claim 33, wherein the lubricant comprises:

polytetrafluoroethylene.

37. The image forming apparatus according to claim 36, wherein the polytetrafluoroethylene is prepared by a compression molding process.

38. The image forming apparatus according to claim 33, wherein the lubricant comprises:

a first polytetrafluoroethylene having a relatively high molecular weight; and a second polytetrafluoroethylene having a relatively low molecular weight relative to the first polytetrafluoroethylene.

39. The image forming apparatus according to claim 33, wherein the lubricant comprises:

polytetrafluoroethylene; and a filler.

40. The image forming apparatus according to claim 33, wherein the image forming apparatus further comprises:

a cleaning device configured to clean a surface of the image carrier, wherein the lubricant supplying device is provided on a surface of the image carrier downstream from the cleaning device with respect to a rotating direction of the image carrier.

41. An image forming apparatus comprising:

an image carrier configured to carry an image while rotating; and a lubricant supplying device configured to supply a lubricant to the image carrier, wherein the lubricant directly contacts the image carrier and a surface of the lubricant includes at least one convex portion facing the image carrier, wherein a contact area at which the lubricant contacts the image carrier changes as the lubricant abrades.

42. The image forming apparatus according to claim 41, wherein said lubricant comprises:

a plurality of convex portions, and wherein said surface of the lubricant further comprises:

a plurality of concave portions, wherein the concave portions are separated by the convex portions, wherein the heights of at least two of the convex portions are different.

43. The image forming apparatus according to claim 41, wherein the lubricant comprises:

polytetrafluoroethylene.

44. The image forming apparatus according to claim 43, wherein the polytetrafluoroethylene is prepared by a compression molding process.

45. The image forming apparatus according to claim 41, wherein the lubricant comprises:

a first polytetrafluoroethylene having a relatively high molecular weight; and a second polytetrafluoroethylene having a relatively low molecular weight relative to the first polytetrafluoroethylene.

46. The image forming apparatus according to claim 41, wherein the lubricant comprises:

polytetrafluoroethylene; and a filler.

47. The image forming apparatus according to claim 41, wherein the image forming apparatus further comprises:

a cleaning device configured to clean a surface of the image carrier, wherein the lubricant supplying device is provided on a surface of the image carrier downstream from the cleaning device with respect to a rotating direction of the image carrier.

48. An image forming apparatus comprising:

an image carrier configured to carry an image while rotating; and a lubricant supplying device configured to supply a lubricant to the image carrier, wherein the lubricant comprises polytetrafluoroethylene and is prepared by a compression molding method including a sintering process, and wherein the lubricant is prepared so that a longitudinal direction of the lubricant is substantially vertical to a compression direction of the lubricant during the compression molding of the lubricant.

49. The image forming apparatus according to claim 48, wherein the lubricant supplying device further comprises:

a lubricant supplying member configured to supply the lubricant to the image carrier.

50. An image forming apparatus comprising:

an image carrier configured to carry an image while rotating; and a lubricant supplying device including a lubricant and configured to supply a lubricant to the image carrier, said lubricant directly contacting the image carrier, wherein the lubricant comprises polytetrafluoroethylene and is prepared by a compression molding method including a sintering process, and wherein the lubricant contacts the image carrier such that an acute angle formed by a line parallel to a compression direction of the lubricant, during the compression molding of the lubricant, and a line parallel to a rotating direction of the image carrier, is from about 45 to 90°.

51. The image forming apparatus according to claim 50, wherein the acute angle is about 90°.

52. The image forming apparatus according to claim 50, wherein the lubricant supplying device further comprises:

a lubricant supplying member configured to supply the lubricant to the image carrier.

53. An image forming method comprising the steps of:

forming a toner image on an image carrier;

transferring the toner image to a receiving material; and applying a lubricant to the image carrier while the image carrier rotates, wherein the lubricant comprises low molecular weight polytetrafluoroethylene.

54. An image forming method comprising the steps of:

forming a toner image on an image carrier;

transferring the toner image to a receiving material; and applying a lubricant to the image carrier while the image carrier rotates, wherein the lubricant comprises a fluorine-containing resin and a filler.

55. An image forming method comprising the steps of:

forming a toner image on an image carrier;

transferring the toner image to a receiving material; and applying a lubricant to the image carrier while the image carrier rotates, wherein the lubricant comprises polytetrafluoroethylene which is subjected to at least one of heat decomposition treatment and radiation decomposition treatment.

56. An image forming method comprising the steps of:

forming a toner image on an image carrier;

transferring the toner image to a receiving material; and applying a lubricant to the image carrier while the image carrier rotates, wherein the lubricant comprises a fluorine-containing resin, and wherein the lubricant is prepared by a compression molding.

57. An image forming method comprising the steps of:

forming a toner image on an image carrier;

transferring the toner image to a receiving material; and applying a lubricant to the image carrier while the image carrier rotates, wherein the lubricant comprises a porous fluorine-containing resin.

58. An image forming method comprising the steps of:

forming a toner image on an image carrier;

transferring the toner image to a receiving material; and applying a lubricant to the image carrier while the image carrier rotates, wherein the lubricant includes a surface which contacts the image carrier, and wherein the surface has at least one concave portion facing the image carrier.

59. An image forming method comprising the steps of:

forming a toner image on an image carrier;

transferring the toner image to a receiving material; and applying a lubricant to the image carrier while the image carrier rotates, wherein the lubricant includes a surface having at least one convex portion facing and contacting the image carrier, and wherein an area of contact between the lubricant and the image carrier changes as the lubricant abrades.

60. An image forming method comprising the steps of:

forming a toner image on an image carrier;

transferring the toner image to a receiving material; and applying a lubricant to the image carrier while the image carrier rotates, wherein the lubricant includes a surface which contacts the image carrier, wherein the lubricant comprises polytetrafluoroethylene and is prepared by a compression molding method including a sintering process, and wherein the lubricant is prepared so that a longitudinal direction of the lubricant is substantially vertical to a compression direction of the lubricant during the compression molding of the lubricant during the compression molding of the lubricant.

61. An image forming method comprising the steps of:

forming a toner image on an image carrier;

transferring the toner image to a receiving material; and applying a lubricant to the image carrier while the image carrier rotates, wherein the lubricant includes a surface which contacts the image carrier, wherein the lubricant comprises polytetrafluoroethylene and is prepared by a compression molding method including a sintering process, and wherein the lubricant contacts the image carrier such that an acute angle formed by a line parallel to a compression direction of the lubricant, during the compression molding of the lubricant, and a line parallel to a moving direction of the image carrier, is from about 45° to 90°.

* * * * *